US010399726B2

(12) United States Patent
Hutchison, III et al.

(10) Patent No.: US 10,399,726 B2
(45) Date of Patent: Sep. 3, 2019

(54) LABEL APPLICATOR FOR SYRINGE LABELING

(71) Applicant: Baxter Corporation Englewood, Englewood, CO (US)

(72) Inventors: James Robert Hutchison, III, Denver, CO (US); Yuriy Konstantinovich Umanskiy, Centennial, CO (US)

(73) Assignee: BAXTER CORPORATION ENGLEWOOD, Englewood, CO (US)

( * ) Notice: Subject to any disclaimer, the term of this patent is extended or adjusted under 35 U.S.C. 154(b) by 123 days.

(21) Appl. No.: 15/360,635

(22) Filed: Nov. 23, 2016

(65) Prior Publication Data

US 2018/0141694 A1 May 24, 2018

(51) Int. Cl.

| | |
|---|---|
| ***B65C 9/18*** | (2006.01) |
| ***B65C 3/02*** | (2006.01) |
| ***B65C 9/00*** | (2006.01) |
| ***B65C 9/32*** | (2006.01) |
| ***B65C 9/04*** | (2006.01) |
| ***B65C 3/12*** | (2006.01) |

(52) U.S. Cl.

CPC ..... *B65C 9/18* (2013.01); *B65C 3/02* (2013.01); *B65C 3/12* (2013.01); *B65C 9/0006* (2013.01); *B65C 9/0015* (2013.01); *B65C 9/04* (2013.01); *B65C 9/32* (2013.01)

(58) Field of Classification Search

CPC .... B65C 2009/0009; B65C 2009/0012; B65C 2009/0093; B65C 9/045; B65C 9/0006; B65C 9/0062; B65C 9/04; B65C 9/18; B65C 9/1865; B65C 9/1869; B65C 9/32; B29C 3/02; B29C 3/12; B29C 3/16

See application file for complete search history.

(56) References Cited

U.S. PATENT DOCUMENTS

| | | | | |
|---|---|---|---|---|
| 3,835,897 | A | 9/1974 | Gess | |
| 8,851,136 | B1 * | 10/2014 | Drynkin | B65C 9/46 156/387 |
| 2005/0188655 | A1 | 9/2005 | Thatenhorst | |
| 2008/0283179 | A1 * | 11/2008 | Sink | B65C 9/0006 156/192 |
| 2009/0242097 | A1 * | 10/2009 | Esposito | B65C 9/188 156/64 |

(Continued)

FOREIGN PATENT DOCUMENTS

| | | |
|---|---|---|
| CA | 2 903 002 | 3/2016 |
| EP | 1 561 690 | 8/2016 |

OTHER PUBLICATIONS

Search Report—PCT/US2016/068252 dated Aug. 10, 2017.

(Continued)

*Primary Examiner* — John L Goff, II
(74) *Attorney, Agent, or Firm* — K&L Gates LLP

(57) ABSTRACT

A label applicator for application of labels to the body of a syringe. The label applicator may be moved into position relative to a predetermined axis along which syringes of different respective sized may be disposed. In this regard, the label applicator may be operative to apply a label to an array of syringes of different sizes. Moreover, the label applicator may print label information onto the label regarding each individual syringe prior to application of a label to the syringe. This may allow for custom label application to each labeled syringe.

11 Claims, 14 Drawing Sheets

(56) References Cited

U.S. PATENT DOCUMENTS

2012/0090761 A1* 4/2012 Herard ..... B65C 3/12
156/64

OTHER PUBLICATIONS

Written Opinion of the International Searching Authority—PCT/US2016/068252 dated Aug. 10, 2017.
Preliminary Report on Patentability for related International Application No. PCT/US2016/068252; action dated Jun. 6, 2019; (7 pages).

* cited by examiner

LABEL APPLICATOR FOR SYRINGE LABELING

RELATED APPLICATIONS

This application relates to and incorporates by reference the co-owned application U.S. Pat. App. No. 62/272,786 by Stultz et al. filed on Dec. 30, 2015 entitled "SYRINGE POSITIONING APPARATUS AND METHOD." This application relates to and incorporates by reference the co-owned application U.S. Pat. App. No. 62/272,789 by Umanskiy et al. filed on Dec. 30, 2015 entitled "MEASUREMENT OF SYRINGE GRADUATION MARKS USING A VISION SYSTEM." This application relates to and incorporates by reference the co-owned application U.S. Pat. App. No. 62/272,794 by Umanskiy et al. filed on Dec. 30, 2015 entitled "CAPACITIVE SINGLE PLATE BUBBLE DETECTOR." This application relates to and incorporates by reference the co-owned application U.S. patent application Ser. No. 14/984,022 by Ward et al. filed on Dec. 30, 2015 entitled "SOURCE FLUID INLET ASSEMBLY FOR AUTOMATED FILLING DEVICE." This application relates to and incorporates by reference the co-owned application U.S. Pat. App. No. 62/272,798 by Hutchison et al. filed on Dec. 30, 2015 entitled "SYRINGE GRIPPING APPARATUS AND METHOD." This application relates to and incorporates by reference the co-owned application U.S. patent application Ser. No. 14/984,285 by Stultz et al. filed on Dec. 30, 2015 entitled "SYRINGE PLUNGER POSITIONING APPARATUS AND METHOD." This application relates to and incorporates by reference the co-owned application of U.S. patent application No. 62/272,816 by Ward et al. filed on Dec. 30, 2015 entitled "INLET TUBE SET FOR SOURCE INGREDIENT DELIVERY." This application relates to and incorporates by reference the co-owned application U.S. patent application No. 14/984,913 by Stultz et al. filed on Dec. 30, 2015 entitled "TIP CAP FOR AUTOMATIC SYRINGE FILING APPARATUS."

FIELD

The present disclosure relates to syringe handling and in particular application of labels to syringes.

BACKGROUND

Many medical care providers utilize syringes in connection with flowable materials for the provision of medical care. For instance, syringes may be used as a container and delivery mechanism for delivery of medication to a patient or as a tool that is utilized during the preparation of a medication. In any regard, it is important to provide information regarding a syringe to users that may handle or use a syringe. Such information may be useful both within and external to a pharmacy environment. Such information may include, for example, information regarding the contents of a syringe or other relevant information pertinent to the syringe that is labeled.

Traditional approaches to pharmacy workflow often involve printing of labels that govern a user's workflow in the pharmacy. For example, the generation of an order for a medication may result in a label corresponding to the order being printed in the pharmacy. In turn, a pharmacy worker may use the label as a guide to determining what medication the pharmacy worker is to prepare. Furthermore, the label may be used to track the medication as a work in progress through the pharmacy. Once a given medication is prepared, the corresponding label that was initially printed in response to the order may be applied to the prepared syringe to identify the medication within the syringe and/or provide other information regarding the prepared syringe. A variety of information may be present on the label including, for example, an identification of the medication(s) contained within the syringe, a concentration of medication(s) contained within the syringe, a patient that is to receive the contents of the syringe, and/or a delivery time/date for the medication, among other possibilities.

Additionally, automated syringe fillers have been proposed that are capable of filling syringes in anticipation of use with a patient or in other medical care contexts. Oftentimes such syringe fillers perform batch processing wherein a plurality of syringes of the same size and containing a common medication are prepared in series. In this context, preprinted labels bearing information regarding the prepared syringes may be applied to the syringe. Such an approach may be feasible when a relatively large quantity of syringes of the same kind and size are prepared such that economical preprinting of labels may be performed for subsequent application to each of the syringes prepared by the syringe filler.

SUMMARY

In view of the foregoing, it is recognized herein that the accurate labeling of syringes is important to pharmacy operation and the provision of medical care to patients. Moreover, the present disclosure recognizes that it may be beneficial to provide flexibility in the preparation of syringes. Specifically, a pharmacy may find advantages in the ability to prepare different syringes that each may contain a variety of different medications for use in a plurality of different applications in a manner that is efficient and accurate. Moreover, because these syringes are often prepared in response to specific patient needs, syringes may be prepared in an ad hoc or just-in-time fashion.

For instance, syringe fillers have been proposed that may be used to prepare different syringes that may each have a different size and/or contents in an automated and ad hoc fashion such that syringes may be prepared in a just-in-time manner in a pharmacy. These syringe fillers may provide efficiencies in the pharmacy because the fillers may be flexible to prepare one-off syringes to fulfill orders (e.g.; as they are retrieved from an order entry system) in an automated manner. For instance, such a syringe filler for filling syringes in an ad hoc manner may be provided according to any of the applications incorporated by reference above.

However, while ad hoc preparation of syringes in a just-in-time fashion may provide efficiencies in the pharmacy, traditional approaches to syringe labeling are inadequate to meet the capabilities provided by such preparation of syringes. For example, given the variety in potential syringe sizes and/or contents, use of preprinted labels may not be practical or efficient. Additionally, manual labeling of syringes may eliminate the efficiency and accuracy provided by the syringe fillers capable of ad hoc syringe preparation. Accordingly, while syringe fillers may be employed to improve pharmacy throughput and facilitate highly efficient and accurate preparation of syringes, there may still be a need to provide labels on the syringes prepared by such fillers. While pharmacy workers may be able to manually apply syringes, this approach may reduce the throughput and accuracy facilitated by automated systems.

In this regard, the present disclosure relates to label applicators that may be used to apply labels to syringes. Specifically, the label applicator described herein may label syringes in an automated fashion that is capable of meeting ad hoc capabilities of syringe fillers. Specifically, the embodiments of label applicators of the present disclosure may be capable of applying labels to syringes prepared by an automated syringe filler in an ad hoc, just-in-time fashion. That is, the label applicator described herein may not have a priori knowledge of a subsequent syringe to be labeled at the time of labeling a given syringe. The label applicator may be operative to generate a label corresponding to the subsequent syringe for application to the subsequent syringe upon preparation of the subsequent syringe. In this regard, the label applicators described herein may provide flexibility in relation to application of labels in such an ad hoc or just-in-time fashion so that the label applicators described herein may be advantageously used in conjunction with an automated syringe filler capable of highly flexible syringe preparation. Accordingly, rather than using preprinted labels that may have to be frequently changed out or manually applied by a user, specifically printed labels corresponding to each given syringe that is prepared may be prepared and applied in an automated fashion.

Embodiments of the label applicators described herein may be operative to apply labels to different syringes having a plurality of sizes without a prior knowledge of the size of a syringe to be labeled prior to generation of the label for the syringe. That is, unlike systems where a labeler is designed or configured for application of labels to a plurality of syringes of a common given size, the label applicator described herein may be operable to apply a label to syringes of different sizes without manual reconfiguration of the applicator. In this regard, the label applicator may be used in conjunction with a syringe filler that is flexible to prepare syringes of various sizes such that the label applicator may be operative to apply a label to different sizes of syringes without manual reconfiguration of the label applicator between label applications. As such, a label applicator may have further flexibility to efficiently and accurately label syringes of a plurality of different sizes.

Further still, the label applicator may be operative to customize the information on a label for a given syringe to be labeled. In turn, information specific to a given syringe including, for example, an identification of the medication(s) contained within the syringe, a concentration of medication (s) contained within the syringe, a patient that is to receive the medication within the syringe, a delivery time/date for the medication, a time/date of preparation, or other specific information related to the given syringe to be labeled may be printed on the label by the label applicator just prior to application of the label to the syringe. Accordingly, the label applicator may be operative to print and apply labels in an ad hoc, just-in-time fashion, thus facilitating flexibility in the automated preparation and labeling of syringes.

Accordingly, a first aspect of the present invention includes a label applicator for application of a label to a syringe. The label applicator includes or is otherwise coordinated with a syringe gripper that is operative to maintain a syringe in a position along a predetermined axis. The syringe gripper is operative to rotate the syringe about the predetermined axis. The label applicator includes a printer operative to print information onto a label disposed on a backing material. The label applicator also includes a peeler that defines a path along which the label and the backing material is advanced. The peeler is operative to separate the label from the backing material to dispose an adhesive portion of the label in engagement with the syringe. Additionally, a rate of advancement of the label is based on a speed of rotation of the syringe by the syringe gripper.

A number of feature refinements and additional features are applicable to the first aspect. These feature refinements and additional features may be used individually or in any combination. As such, each of the following features that will be discussed may be, but are not required to be, used with any other feature or combination of features of the first aspect.

For example, the printer and the peeler may be mounted on a chassis that is moveable relative to the predetermined axis. Specifically, the chassis may be linearly moveable in a first direction relative to the predetermined axis. In turn, at least the peeler may include a displaceable portion for movement relative to the chassis in a second direction different than the first direction. The displaceable portion may include a cam follower that is operative to engage a cam that defines a prescribed movement of at least the peeler in the second direction for positioning of the adhesive portion of the label in engagement with the syringe upon separation of the label from the backing material.

Additionally, the syringe gripping apparatus may be operative to engage different respective syringes of a plurality of diameters. As such, the cam may define a plurality of positions relative to the linear motion of the chassis corresponding to the plurality of diameters. In this regard, the prescribed movement may include advancement of the peeler toward the predetermined axis in the second direction in response to movement of the chassis in the first direction. At least a component of the second direction may be perpendicular to the linear motion of the chassis in the first direction.

In an embodiment, the displaceable portion may be pivotal relative to the chassis. For instance, the displaceable portion may be engaged with a hinge that facilitates the pivotal movement. The displaceable portion may be biased against movement in the second direction.

In an embodiment, the syringe gripping apparatus may include at least one roller. In turn, the peeler may be operative to dispose the label in contacting engagement with the syringe relative to the roller such that the label passes between the at least one roller and the syringe after engagement of the adhesive portion of the label with the syringe and upon rotation of the syringe by the syringe gripping apparatus. In this regard, the roller may apply a pressure to the label to adhere the label to the syringe. Moreover, a portion of the label that may include a non-permanent adhesive may be smoothed along the body of the syringe.

In an embodiment, the label may comprise a configuration adapted for use with the label applicator. For example, the label may include a width perpendicular to a direction of advancement of the label along the path. Additionally, the label may include a length along the direction of advancement of the label along the path. Further still, the label may include a first side in contacting engagement with the backing material and a second side opposite the first side on which the printer is operative to print the information. The adhesive portion extends on the first side along a first portion of the length of the label less than the length. For instance, the adhesive portion of the label may be offset from a leading edge of the label relative to the direction of advancement. Specifically, the label may be offset from the leading edge of the label relative to the direction of advancement a distance less than the first portion of the length along which the adhesive portion extends. The label may include a tacky portion (i.e., that is not permanently adhesive) on the first side in an area mutually exclusive of the adhesive portion. In this regard, the tacky portion is repeatedly may be detachably engageable with the second side of the label.

In an embodiment, the backing material may include a plurality of labels for application to a corresponding plurality of syringes. The adjacent labels on the backing may be spaced such that a subsequent label is printed after application of a given label to a syringe. In an embodiment, the subsequent label may be moved into position relative to the printer for printing on the subsequent label by reversing the backing material relative to the path prior to printing.

In an embodiment, the label applicator may also include a supply roll comprising a plurality of labels disposed on the backing material. The label applicator may also include a take-up roll about which backing material is wound subsequent to separation from the label. In this regard, the path may be defined between the supply roll and the take-up roll. Further still, the path may include an inflection point at which the label is separated from the backing material. At least one roller may be disposed for contacting engagement with the backing material to reduce friction between the backing material and the peeler adjacent to the inflection point.

A second aspect includes a method for applying a label to a syringe. The method includes printing information onto a label disposed on a backing material. The information is associated with a syringe to which the label is to be applied. The method also includes advancing the label along a path at least partially defined by a peeler. Further still, the method includes separating the label from the backing material by the peeler in response to the advancing of the label along the path and contacting an adhesive portion of the label separated from the backing material with a portion of a syringe body. The method also includes rotating the syringe body at least after the contacting and concurrently with the advancing after the contacting. Specifically, a rate of the advancing is based on a speed of the rotating.

A number of feature refinements and additional features are applicable to the second aspect. These feature refinements and additional features may be used individually or in any combination. As such, each of the following features that will be discussed may be, but are not required to be, used with any other feature or combination of features of the second aspect.

For example, the method may include moving the peeler relative to the syringe body to dispose the label in contacting engagement with the syringe body in response to the advancing. The peeler may be moved in a prescribed motion relative to the syringe to a given one of a plurality of positions corresponding to a respective plurality of different syringe diameters.

In an embodiment, the rate of the advancing and the speed of the rotating is based on a corresponding diameter of the syringe to which the label is to be applied. In this regard, upon determination of a diameter of the syringe to which the label is to be applied, a rate of the advancing may be determined to prevent the label from being misapplied to the syringe. Specifically, matching the rate of advancement to the speed of rotation may minimize sheer forces or buckling of the label when applied to the syringe. In an embodiment, the rotating may include passing the label between a roller and the syringe body to adhere at least a portion of the label to the syringe.

A third aspect includes a label for application to a syringe. The label includes a first side comprising an adhesive portion and a tacky portion. The adhesive portion extends in a first area of the first side comprising a first portion of a length of the label less than the entire length of the label and an entire width of the label. The tacky portion extends in a second area of the first side mutually exclusive of the first area. The label includes a second side opposite the first side configured to receive printed information from a printer regarding a syringe to which the label is to be applied. The adhesive portion is configured for non-releasable engagement with a syringe body, and the tacky portion is configured for repeatedly detachable engagement with the second side of the label and the syringe body.

A number of feature refinements and additional features are applicable to the third aspect. These feature refinements and additional features may be used individually or in any combination. As such, each of the following features that will be discussed may be, but are not required to be, used with any other feature or combination of features of the third aspect. For instance, the label of the third aspect may be used in conjunction with the label applicator of the first aspect or in the method of the second aspect without limitation.

DETAILED DESCRIPTION

The following description is not intended to limit the invention to the forms disclosed herein. Consequently, variations and modifications commensurate with the following teachings, skill and knowledge of the relevant art, are within the scope of the present invention. The embodiments described herein are further intended to explain modes known of practicing the invention and to enable others skilled in the art to utilize the invention in such, or other embodiments and with various modifications required by the particular applications(s) or use(s) of the present invention.

Figure 1:
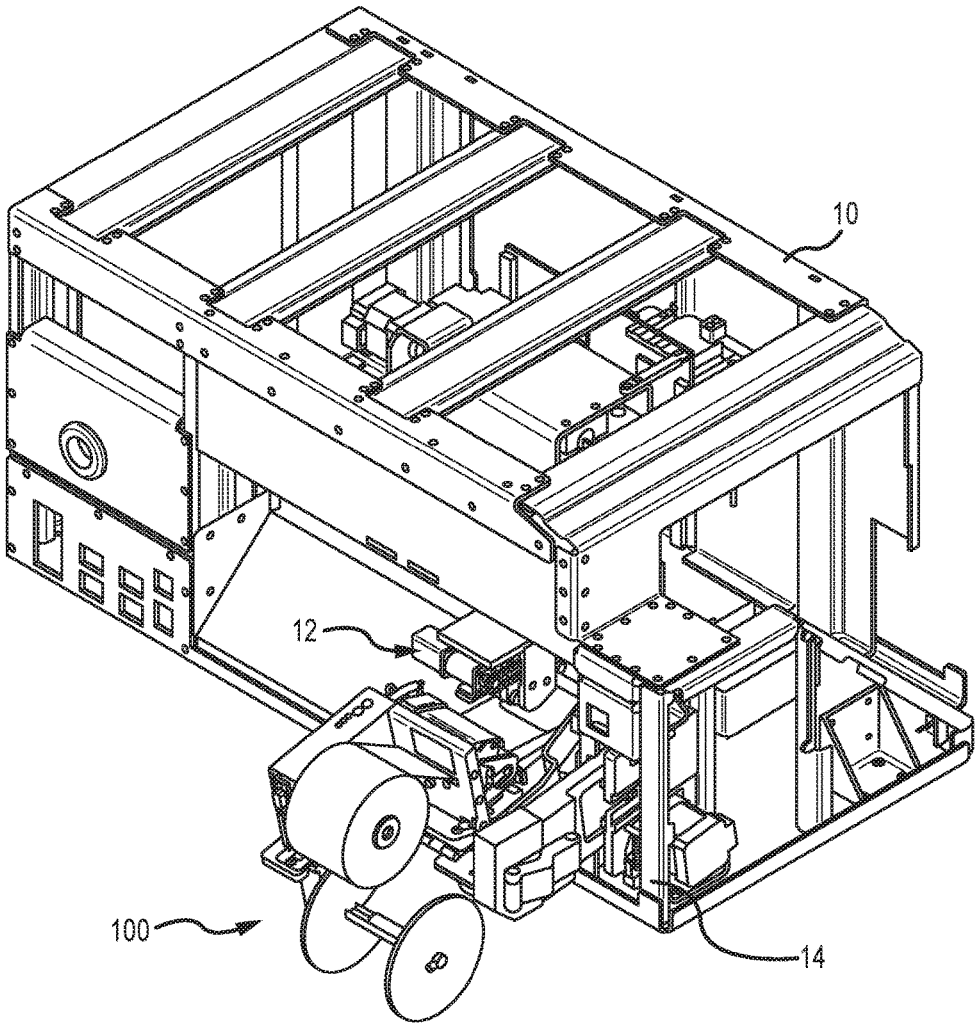
FIG. 1 is a perspective view of an embodiment of an automated syringe filler having an embodiment of a label applicator associated therewith for application of labels to syringes filled by the automated syringe filler.

FIG. 1 depicts an embodiment of a syringe filler 10 that may be used in conjunction with a label applicator 100. The syringe filler 10 may be according to and/or incorporate any features of any of the disclosures incorporated by reference above. In an embodiment, the syringe filler 10 may be an automated syringe filler that is used to prepare syringes by filling the syringe with a medication or other substance. Syringes prepared by the automated syringe filler 10 may be used for delivery of a medication to a patient, as a tool in the preparation to compound a medication for administration to a patient, or in any other appropriate context in which a syringe may be used. The automated syringe filler 10 may be capable of filling syringes with a medication or substance that may be selected from a plurality of potential substances contained in source containers with which the automated syringe filler 10 is in fluid communication. In turn, the automated syringe filler 10 may be capable of preparing a plurality of different medications and/or other ingredients to be contained in a syringe. In addition, the syringe filler 10 may be capable of filling syringes having different respective sizes and/or volumes. Specifically, each subsequent syringe prepared using the syringe filler 10 may be of a different size or volume and contain a different medication than the previously prepared syringe.

Accordingly, the syringe filler 10 may prepare syringes on an ad hoc, just-in-time basis. That is, the syringe filler 10 may be operative to fill a first given syringe of a first size and/or first volume and thereafter fill a second given syringe of a second size and/or second volume different than the first size and/or first volume without manual reconfiguration of the syringe filler 10 between the first syringe and the second syringe (e.g., in an at least partially automated manner that does not require human intervention to reconfigure the syringe filler 10 between uses). As may be appreciated, this may provide flexibility as the syringe filler 10 may be operative to prepare even a single syringe with a given amount of a substance in an efficient automated manner. As such, multiple different syringes of different respective various sizes and/or volumes and/or containing different substances may be prepared in an automated fashion by the syringe filler 10 without requiring manual reconfiguration of the syringe filler 10. In turn, the syringe filler 10 may be operative to prepare a syringe based on receipt of an order from an order entry system or the like. Even an order for a single syringe of a given type may be ordered via the order entry system may be prepared in an automated fashion by the syringe filler 10. As such, the syringe filler 10 may provide efficiencies within a pharmacy by allowing many differed types of syringes to be prepared in an automated fashion, even if the ordered quantity of a given type of syringe is low.

The syringe filler 10 may include or be operatively interfaced with a label applicator 100. The label applicator 100 may be operative to apply a label to a syringe that has been filled by the syringe filler 10. While the label applicator 100 may be discussed as being used in conjunction with the syringe filler 10 in embodiments described herein, the label applicator 100 may similarly be used for other applications in which labels are to be applied to syringes. For instance, an independent syringe labeler may be provided that incorporates a label applicator 100 as described herein (e.g., for use in contexts other than an automated filler 10). In such an embodiment, the independent syringe labeler may be used in connection with any other device or may be used as a standalone device to apply a label to a syringe. A label applicator may be used with other devices that handle syringes including, for example, during syringe manufacture or the like.

The label applicator 100 may be supportably engaged by a frame structure 14 of the syringe filler 10. In FIG. 1, the syringe filler 10 is shown with portions of a cover or shielding omitted to illustrate the frame structure 14 more clearly. The frame structure 14 may also supportably engage a syringe gripper 12. As described in the applications incorporated above, the syringe gripper 12 may comprise a portion of a syringe handling system that may be used by the syringe filler 10 to manipulate a syringe for operations related to syringe filling (e.g., including orienting a syringe, decapping a syringe, filling a syringe, capping a syringe, etc.). In any regard, the label applicator 100 may be disposed relative to at least one position of the syringe gripper 12 for interfacing with a syringe gripped by the syringe gripper in a manner described in detail below.

Turning to FIGS. 2-5, a label applicator 100 is depicted relative to a syringe gripper 12. As described above, the syringe gripper 12 may also be supported by the frame 14 of the syringe filler 10. However, in FIGS. 2 and 3, the frame structure 14 and other portions of the syringe filler 10 are omitted for clarity. Moreover, in FIGS. 4 and 5, components of the syringe gripper 12 other than syringe grippers 18 are omitted to show with clarity an interface between the label applicator 100 and a syringe 16 engaged by the syringe grippers 18 as will be discussed below. The label applicator 100 and the syringe gripper 12 may be supportably engaged by the frame structure 14 or in any other appropriate manner to dispose the components in the relative positions shown in FIG. 2-5.

As will be described in greater detail below, the label applicator 100 may include a printer 150 and a peeler 200. The printer 150 may be capable of printing information onto a label 158 to be applied to a syringe 16. The peeler 200 may define path 162 along which backing material 160 supporting one or more labels 158 may travel. As will be described in greater detail below, the peeler 200 may be used to advance a label 158 into a position such that the label 158 is positioned relative to the syringe 16. In addition, the peeler 200 may be used to separate the label 158 from the backing 160 to expose an adhesive portion of the label 158 for application of the label 158 to the syringe 16 as will be described in greater detail below.

With continued reference to FIGS. 2-5, the printer 150 and peeler 200 may be supportably engaged on a chassis 102. The chassis 102 may be disposed for movement relative to a mounting plate 104, which may be supportably engaged with the frame structure 14. The mounting plate 104 may support a motor 106. In turn, the motor 106 may be operative to move the chassis 102 relative to the frame structure 104. Accordingly, the position of the chassis 102 relative to a predetermined axis AA may be controlled by operation of the motor 106. As will be described below, the syringe gripper 12 may maintain a syringe 16 relative to (e.g., axially aligned with) the predetermined axis AA. In this regard, the chassis 102 may be controllably positionable relative to a syringe 16 maintained along the predetermined axis AA.

In one embodiment, the mounting plate 104 and the chassis 102 may be configured such that the chassis 102 may undergo linear movement relative to the mounting plate 104. Accordingly, one or more linear slides (not visible in FIGS. 2-5) may be provided between the mounting plate 104 and the chassis 102 such that the mounting plate 104 is secured to a first portion of the one or more linear slides and the chassis 102 is secured to a second portion of the one or more linear slides. In turn, the chassis 102 may be disposed for linear movement relative to the mounting plate 104 in a first direction. The linear slide may comprise a linear bearing including, for example, a ball bearing interface to allow for precise, low friction linear movement between the chassis 102 and the mounting plate 104.

The motor 106 that is supported by the mounting plate 104 may have a drive gear 110 secured to an output shaft of the motor 106. The drive gear 110 may engage a rack 112 disposed on the chassis 102. The motor 106 may be mounted to allow relative movement between the motor 106 and the mounting plate 104 such that the drive gear 110 may be displaceable away from the rack 112. A biasing member 114 (e.g., a spring member or the like) may be provided to bias the motor 106 in a direction toward the rack 112 such that the drive gear 110 is biased into meshed engagement with the rack 112. In turn, driven rotation of the motor 106 may result in linear movement of the chassis 102 relative to the mounting plate 104, and in turn relative to the frame structure 14 to which the mounting plate 104 is secured. However, should the chassis 102 bind or contact an obstruction, the motor 106 may be displaced such that the drive gear 110 moves away from the rack 112, thus reducing the potential for damage to the motor 106, drive gear 110, and rack 112.

Figure 2:
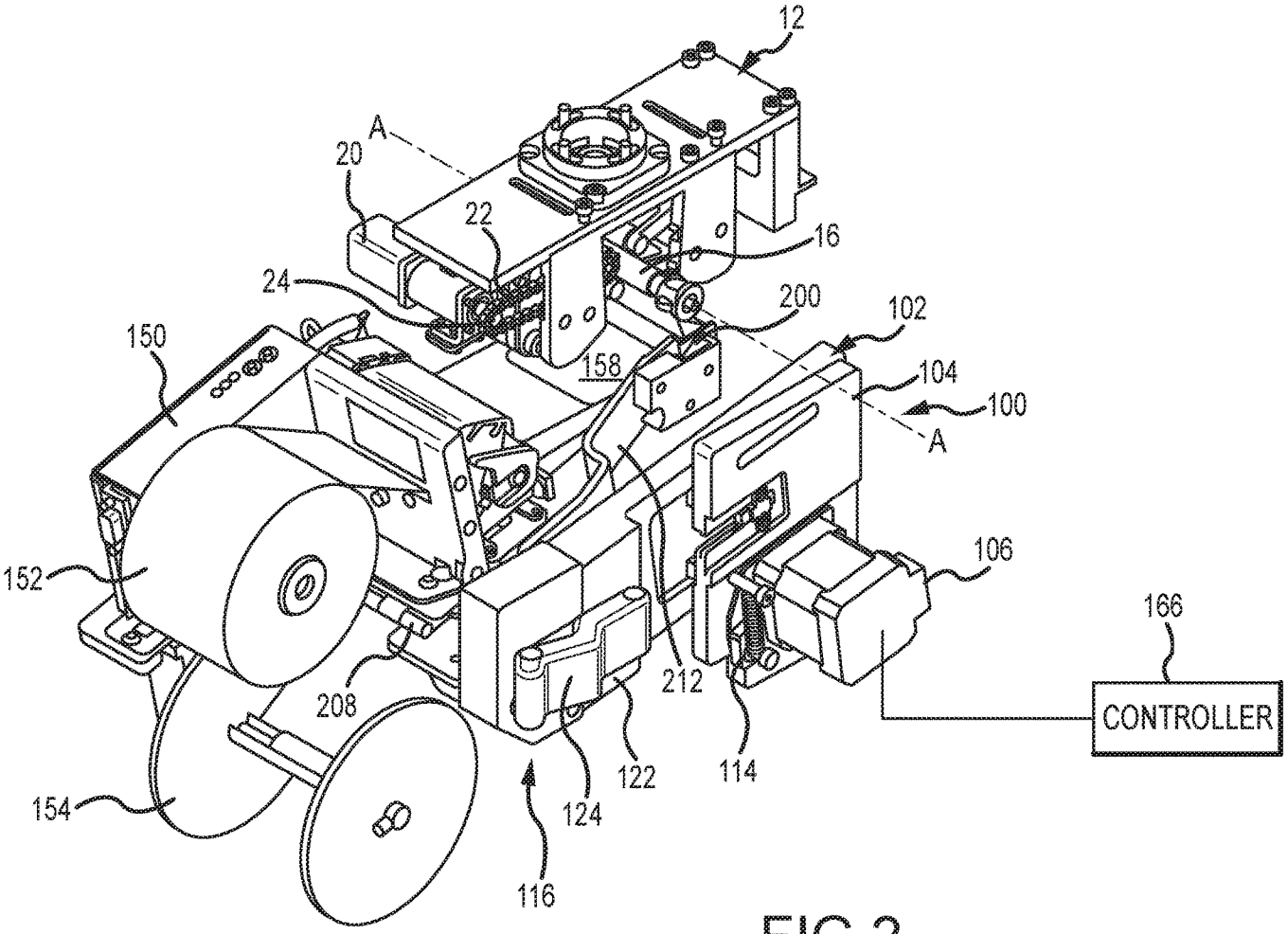
FIG. 2 is a perspective view of an embodiment of a label applicator disposed relative to a syringe gripping apparatus for application of a label to a syringe held by the syringe gripping apparatus.

The linear movement of the chassis 102 relative to the mounting plate 104 may also produce relative motion of the chassis 102 relative to a syringe 16 that is disposed on a predetermined axis AA by the syringe gripper 12 as will be described in greater detail below. The motor 106 may be in operative communication with a controller 166 for control of the operation of the motor 106. The controller 166 is schematically depicted in FIG. 2. The controller 166 may comprise a processor in operative communication with a memory device or the like. In turn, the controller 166 may be operative to access instructions maintained in the memory device to configure the processor of the controller 166 to control the motor 106 according to the operation described herein. Furthermore, the controller 166 may be in operative communication with one or more sensors arranged relative to the chassis 102. In turn, a home position of the chassis 102 may be established such that the controller 166 may be operative to move the chassis 102 to a home position. Other sensors (e.g., over-travel sensors, position indicating sensors, etc.) may also be in communication with the controller 166 to provide inputs for control of the motor 106. In any regard, any movement of the chassis 102 may be controllable by the controller 166 to dispose the chassis 102 in a plurality of predetermined positions in the first direction along the linear path of the chassis 102 relative to the mounting plate 104. For instance, the motor 106 may be equipped with an encoder that provides information to the controller 166 regarding the precise position of the chassis 102 relative to the home position.

The chassis 102 may include a detachable portion 116 that is selectively detachable from an actuator plate 122 of the chassis 102. In this regard, the detachable portion 116 may include a portion of the chassis 102 including the printer 150 and peeler 200. The detachable portion 116 may be removed from the actuator plate 122 (e.g., for maintenance, cleaning, setup, or the like). The actuator plate 122 may remain engaged with the drive gear 110 so as not to disrupt a known position of the chassis 102 relative to the home position.

Figure 6:
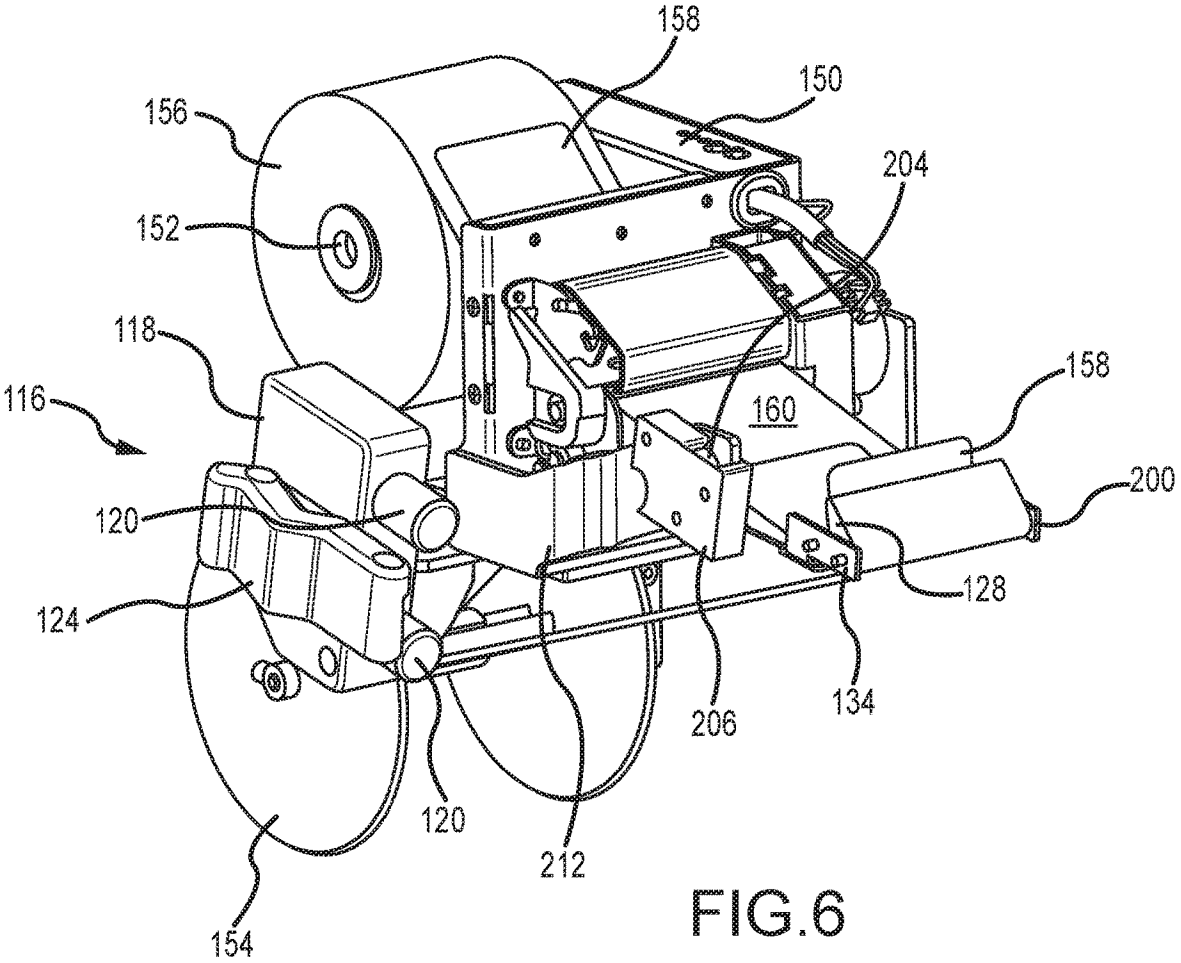
FIG. 6 is a front perspective view of an embodiment of a removable portion of a printer chassis comprising a printer and peeler that may be removed from the remainder of the chassis.
Figure 7:
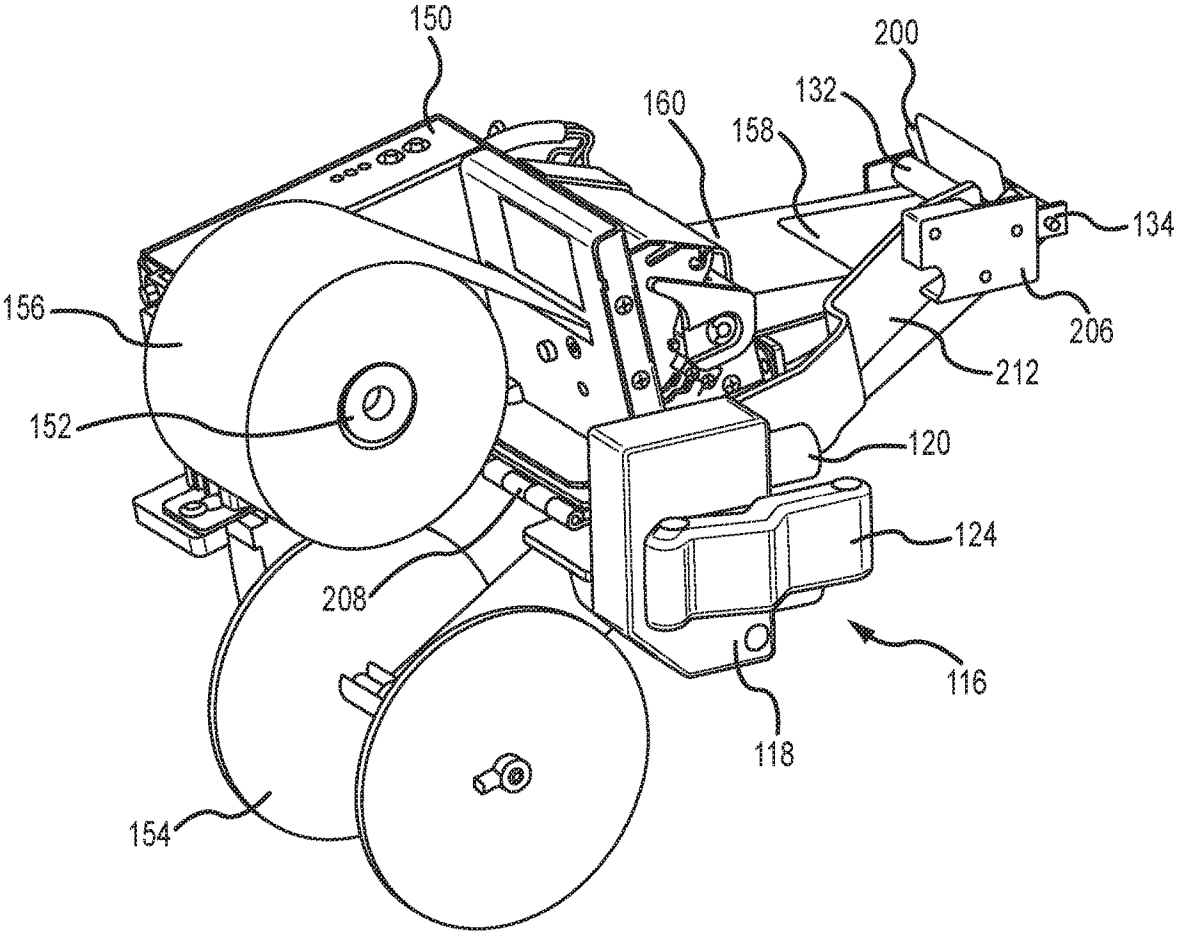
FIG. 7 is a rear perspective view of an embodiment of a removable portion of a printer chassis comprising a printer and peeler that may be removed from the remainder of the chassis.

The detachable portion 116 is shown in detail in FIGS. 6-7. Specifically, the detachable portion 116 may have a mounting bracket 118 comprising one or more posts 120 extending therefrom. The posts 120 may engage corresponding holes (not shown) provided in the actuator plate 122 of the chassis 102. Engagement of the posts 120 and the holes may align the detachable portion 116 relative to the actuator plate 122. In turn, a clasp 124 may be provided to selectively secure the removable portion 116 to the actuator plate 122 of the chassis 102. The clasp 124 may selectively span between the detachable portion 116 and the actuator plate 122 to secure the detachable portion 116 to the actuator plate 122. The clasp 124 may be hand operated to provide efficient and easy removal of the removable portion 116 from the actuator plate 122 even, for example, by a user wearing sterile gloves or the like.

In the event of the need to access the printer 150 and/or peeler 200, a user may disengage the clasp 124 and remove the removable portion 116 from the actuator plate 122. In turn, the printer 150 and/or peeler 200 may be more readily accessed by the user when removed from the actuator plate 122. To re-secure the removable portion 116 to the actuator plate 122, the user may dispose the removable portion 116 into position such that the posts 120 engage the actuator plate 122 to orient the removable portion 116 relative to the actuator plate 122. The clasp 124 may be reengaged with the actuator plate 122. As the actuator plate 122 may remain in position while the removable portion 116 is removed, operation of the label applicator 100 may continue without requiring the chassis 102 to be rehomed. Accordingly, an operation to the printer 150 and/or peeler 200 may be easily performed with removal of the removable portion 116 with minimal disruption to the operation of the label applicator 100. An interlock sensor may be provided such that operation of the syringe filler 10 and/or label applicator 100 are prevented when the removable portion 116 is remove from the actuator plate 122.

With continued reference to FIGS. 6 and 7, which show the printer 150 and peeler 200, the printer 150 may comprise any appropriate printing device capable of printing information onto a label 158. For instance, the printer 150 may be a thermal printer, an inkjet printer, a laser printer, etc. In any regard, the printer 150 may include a label supply reel 152 and a take-up reel 154. The supply reel 152 may accept a supply roll 156 comprising labels 158 applied to a backing material 160. The labels 158 may comprise one or more adhesive portions that are in contact with the backing material 160 when the labels 158 are supplied in the roll 156 as described in greater detail below. The backing material 160 may pass through the printer 150, travel along a path 162 relative to the peeler 200, and eventually be spooled about the take-up reel 154. In this regard, the supply reel 152, printer 150, peeler 200, and take-up reel 154 may collectively define the path 162 along which the backing material 160 travels. The supply reel 152 and/or take-up reel 154 may be driven. Moreover, operation of the supply reel 152 and/or take-up reel 154 may be controller 166 to control the position of one or more labels 158 disposed on the backing material 160. In this regard, the position of a label 158 along the path 162 may be controlled (e.g., by the controller 166) to advance and/or retract a label 158 along the portion of the path 162 defined between the supply reel 152 and a ramp 128 of the peeler 200. Specifically, the backing material 160, and in turn one or more labels 158, may be advanced along the path 162 by an unrolling action of the supply reel 152 (i.e., rotation of the supply reel 152 in a direction causing the backing material 160 to unroll from a supply roll 156) and a rolling action of the take-up reel 154 (i.e., rotation of the take-up reel 154 in a direction causing the backing material 160 to roll about the take-up reel 154). Retraction of the backing material 160 and labels 158 may occur by a rolling action of the supply reel 152 and an unrolling action of the take-up reel 154.

Figure 10:
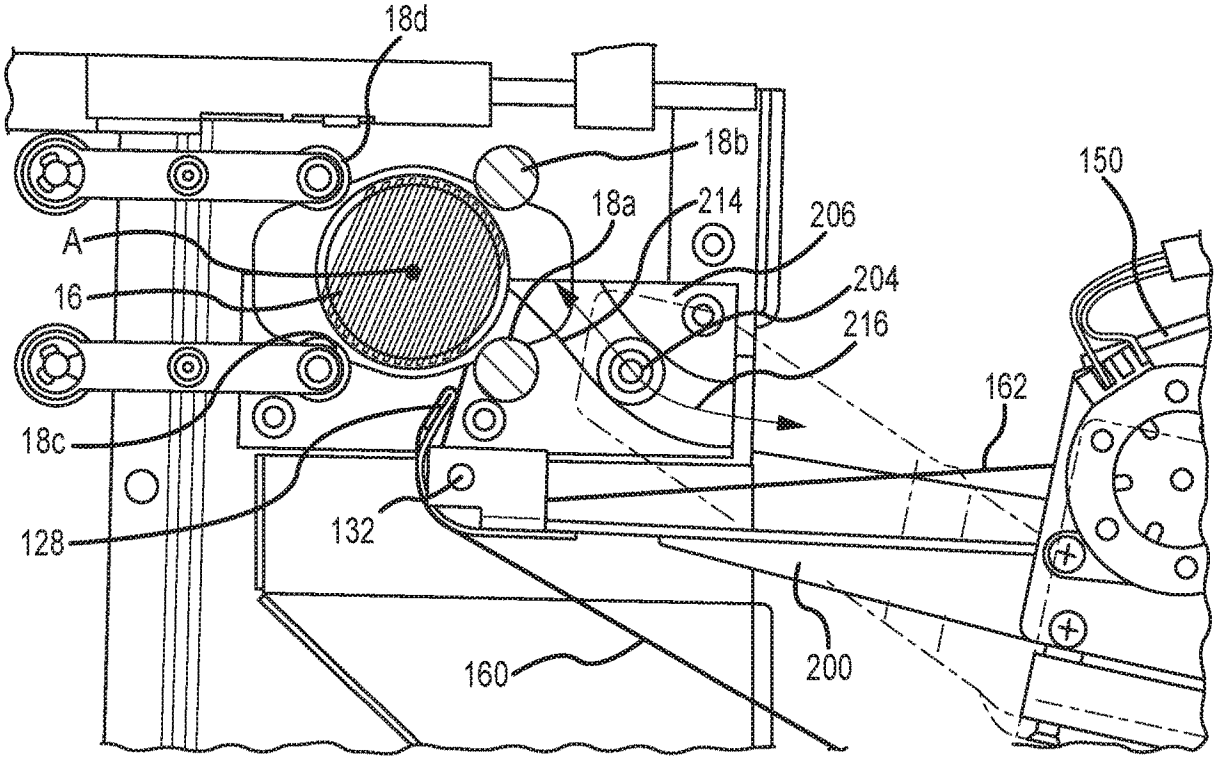
FIG. 10 illustrates a cam profile for positioning an embodiment of a peeler relative to a syringe for application of a label to the syringe.

In any regard, advancement and/or retraction of the backing material 160 may cause one or more labels 158 to move from the supply roll 156 along the path 162. The path 162 may extend about an extension portion 126 of the peeler 200. The peeler 200 may also feature a ramp 128 at a distal end of the extension portion 126. The path 162 may also extend about the ramp 128 such that the ramp 128 defines an inflection point 130 about which the backing material 160 bends as the backing material 160 travels along the path 162 about the ramp 128. In one specific embodiment, a first roller 132 is provided on a first side of the ramp 128 and a second roller 134 is provided on a second side the ramp 128. The backing material 160 may pass relative to the first roller 132 on a side opposite the ramp 128. In this regard, the first roller 132 may assist in defining the path 162 such that the backing material 160 undergoes sufficient bending about the ramp 128 to separate a label 158 from the backing material 160 as a label 158 passes the inflection point 130 defined by the ramp 128 as described in greater detail below. The second roller 134 may contact the backing material 160 on a side of the inflection point 130 opposite the first roller 132. The second roller 134 may assist in reducing the frictional forces that the backing material 160 experiences as it passes past the inflection point 130 and moves toward the take-up reel 154. After the backing material 160 passes by the second roller 132, the backing material 160 may be wound about the take-up reel 154. An alternative embodiment is depicted in FIG. 10. In FIG. 10, the first roller 132 may be provided. However, the second roller 134 may be omitted such that the backing material 160 travels along a distal side of the ramp 128 and thereafter travels along the path 162 toward the take-up reel 154.

Figure 8:
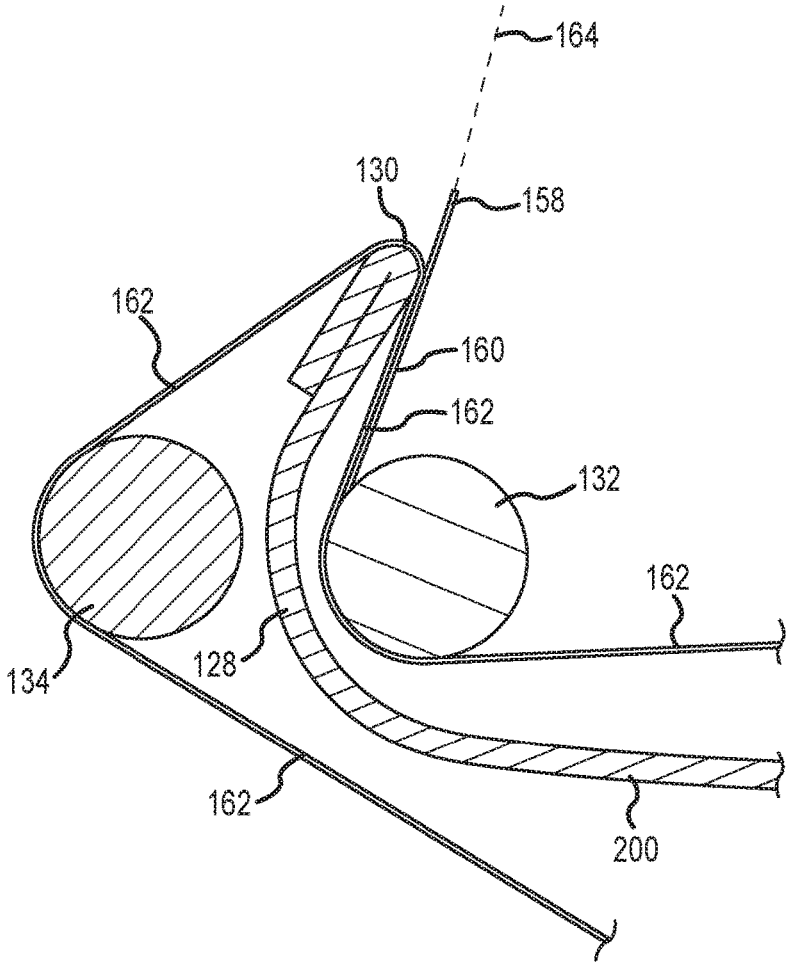
FIG. 8 is a cross sectional view of a portion of an embodiment of a peeler depicting a path relative to a ramp of the peeler for separation of a label from backing material.

Advancing a label 158 along the path 162 about the ramp 128 relative to inflection point 130 may cause the label 158 to separate from the backing material 160 adjacent to the inflection point 130. This is shown in FIG. 8, which shows a cross sectional view of a distal end of an embodiment of a peeler 200 including a ramp 128 relative to the path 162. As the backing material 160 may undergo a sharp bend corresponding to the inflection point 130 at a distal end of the ramp 128, the label 158 may continue along a trajectory 164 that is generally tangential to the distal portion of the ramp 128 defining the inflection point 130. That is, the label 158 may be separated from the label backing 160 as the label backing 160 is bent about the inflection point 130 at the distal portion of the ramp 128. The separation may occur because the label backing 160 may be bent about the inflection point 130 in a direction away from an adhesive portion of the label 158 that is initially adhered to the backing material 160. In turn, the label 158 may continue along the trajectory 164 that generally follows the tangential trajectory of the path 162 adjacent to the inflection point 130. Accordingly, a label 158 may be separated from the backing material 160 as the backing material 160 carrying the label 158 is advanced beyond the inflection point 130 along the path 162.

In turn, the distal end of the ramp 128 adjacent to where the label 158 separates from the backing material 160 may be disposed adjacent to a syringe 16 to be labeled such that the label 158 (e.g., an adhesive portion thereof) may contact the syringe 16 when advanced beyond the inflection point 130 and along the trajectory 164. That is, advancement of the label 158 beyond the inflection point 130 of the ramp 128 may cause the label 158 to separate from the backing material 160 such that an adhesive portion of the label 158 is exposed. In turn, the adhesive portion may make contact with a syringe 16 if the ramp 128 is positioned adjacent to a syringe 16 to be labeled.

If a syringe 16 of a given size and/or diameter were to be repeatedly labeled, the peeler 200 comprising the ramp 128 may be disposed in a stationary position relative to a location of the plurality of syringes 16 to be labeled that each have a common diameter. However, as described above, a syringe gripper 12 may be operative to handle syringes 16 of various different diameters. Specifically, the syringe gripper 12 may be operative to dispose syringes having different diameters along the predetermined axis AA. As the syringes 16 may be disposed along the common predetermined axis AA (e.g., a central axis of the syringe 16 may be disposed along the predetermined axis AA), gripping of respective different syringes 16 having different diameters may result in the sidewall of the various different syringes 16 being disposed in different locations relative to the predetermined axis AA for each different diameter of syringe capable of being handled by the syringe gripper 12. In turn, a stationary peeler 200 may not allow for consistent label application in relation to syringes 16 of various diameters.

In turn, a label applicator 100 according to the present disclosure may be operative to dispose the ramp 128 of the peeler 200 in different positions relative to the predetermined axis AA. These different positions relative to the predetermined axis AA may correspond to respective different diameters of different respective syringe sizes that may be gripped by the syringe gripper 12. For example, the chassis 102 may be moveable to position the ramp 128 of the peeler 200 in a position relative to a syringe 16 to be labeled such that a separated label 158 may be applied to a syringe 16 once advanced beyond the inflection point 130. Because the chassis 102 may be positionable relative to a syringe 16, different sized syringes 16 may be labeled by selectively disposing the chassis 102 in a position corresponding to the diameter of syringe 16 to be labeled as will be described below. For purposes of description, the positioning of a separated label 158 relative to one embodiment of a syringe gripper 12 is initially described. Thereafter, an embodiment of a label applicator 100 is described that allows for control of the location of the ramp 128 for label placement relative to syringes 16 of different given sizes.

Figure 3:
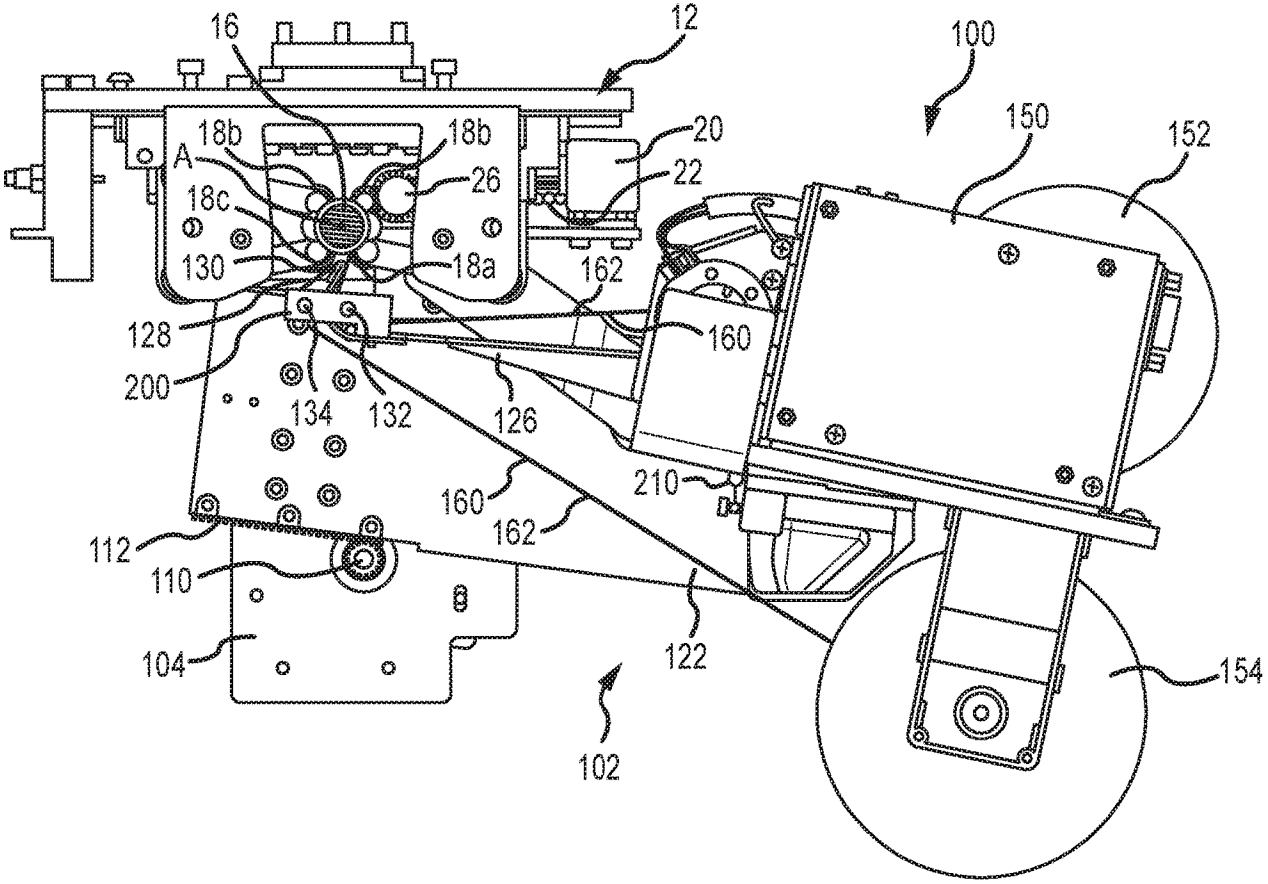
FIG. 3 is a rear view of an embodiment of a label applicator in position for application of a label to a syringe held by a syringe gripping apparatus.

One embodiment of a syringe gripping apparatus 12 is shown in detail in FIGS. 2-3, which may be provided according to the incorporated applications described above. The syringe gripping apparatus 12 may include four gripping members 18*a*, 18*b*, 18*c*, 18*d* that are advanceable in four corresponding different directions towards a predetermined axis AA extending between the gripping members 18*a*, 18*b*, 18*c*, 18*d*, so as to supportably engage, at circumferentially offset locations, a syringe 16 located in an axially aligned position on the predetermined axis AA. In the figures, the gripping members 18*a*, 18*b*, 18*c*, 18*d* are shown in an advanced, syringe engagement position. However, the gripping members 18*a*, 18*b*, 18*c*, 18*d* may be moved to a retracted, or open position, wherein a syringe may be located between the gripping members 18*a*, 18*b*, 18*c*, 18*d* in an axially aligned position on the predetermined axis AA for subsequent supportive engagement. For instance, when a syringe is located in an axially aligned position on the predetermined axis AA, the gripping members 18*a*, 18*b*, 18*c*, 18*d* may be advanced radially relative to the syringe 16 in tandem to engage the syringe 16, at corresponding circumferentially offset locations, with gripping members 18*a*, 18*c* engaging the syringe at locations lower than the predetermined axis AA, and with gripping members 18*b*, 18*d* engaging the syringe at locations higher than the predetermined axis AA. Accordingly, it may be appreciated that syringes 16 of different respective diameters may be engaged by the syringe gripper 12, with each syringe 16 being aligned along predetermined axis AA.

In the illustrated embodiment, the gripping members 18*a*, 18*b*, 18*c*, 18*d* may be provided to substantially simultaneously engage a syringe located in an axially aligned position on the predetermined axis AA. Further, the gripping members 18*a*, 18*b*, 18*c*, 18*d* may be provided to engage the syringe at offset locations, wherein adjacent ones of the offset locations are equispaced (e.g. at 90° offset locations about the circumference of the syringe 16).

The gripping members 18*a*, 18*b*, 18*c*, 18*d* may be provided to have corresponding gripping surfaces that extend parallel to the predetermined axis AA. In turn, when a syringe 16 is located on the predetermined axis AA, as shown in FIGS. 2-5, the gripping members 18*a*, 18*b*, 18*c*, 18*d* may be advanced so that the gripping surfaces thereof engage the syringe along circumferential portions that extend parallel to the predetermined axis AA. In that regard, in illustrated embodiment, the gripping members 18*a*, 18*b*, 18*c*, 18*d* may each have a common cylindrical configuration, wherein each of the gripping members 18*a*, 18*b*, 18*c*, 18*d* may have a corresponding center axis that extends parallel to the predetermined axis AA. Further, the gripping members 18*a*, 18*b*, 18*c*, 18*d* may be disposed to engage a common length of a syringe located in an axially aligned position on the predetermined axis AA.

The syringe gripping apparatus 12 may be further provided to rotate a syringe 16 supportably engaged thereby. For such purposes, the gripping members 18*a*, 18*b*, 18*c*, 18*d* may comprise corresponding tubular rollers disposed on corresponding shaft members for rotation thereabout. To provide for driven rotation of a syringe 16, the syringe gripping apparatus 12 may include an electric motor 20 having a rotatable output shaft operatively interconnected to a single gripping member 18*b* for driven rotation of the roller of gripping member 18*b*. In that regard, a drive chain 22 may be provided to mesh with teeth of a first sprocket gear 24 fixedly interconnected to the rotatable output shaft, and with a rotatable second sprocket gear 26 provided to mechanically interface the drive chain 22 with the gripping member 18*b*. In turn, operation of the motor 20 rotates the output shaft and first sprocket gear 24 so as to drive the drive chain 22 and rotate the second sprocket gear 26, and thereby rotate the roller of gripping member 18*b*. In turn, upon driven rotation of the roller of gripping member 18*b*, a syringe 16 supportably engaged by gripping members 18*a*, 18*b*, 18*c*, 18*d* may be rotated. In that regard, the rollers of gripping members 18*a*, 18*c*, 18*d* may be provided to freely rotate about their corresponding shaft members. In turn, upon driven syringe rotation of the roller of gripping member 18*b*, the rollers of each of the gripping members 18*a*, 18*c*, 18*d* co-rotate with the syringe 16 and the roller of the first gripping member 18*b*, while supportably engaging the syringe 16 on the predetermined axis AA. The speed of the rotation of the sprocket gear 24 may be controlled by the controller 166. In turn, the speed of rotation of the syringe 16 about the predetermined axis AA may be controlled.

In this regard, positioning the peeler 200 of the label applicator 100 relative to the rollers of the gripping members 18*a*, 18*b*, 18*c*, 18*d* may allow for a label 158 to be applied to a syringe 16 gripped by the syringe gripper 12. Moreover, coordination of the advancement of the backing material 160 along the path 162 with the rotation of the syringe 16 by the rollers of the gripping members 18*a*, 18*b*, 18*c*, 18*d* may provide for application of the label 158 and smoothing of the label 158 when applied to the syringe 16.

Figure 4:
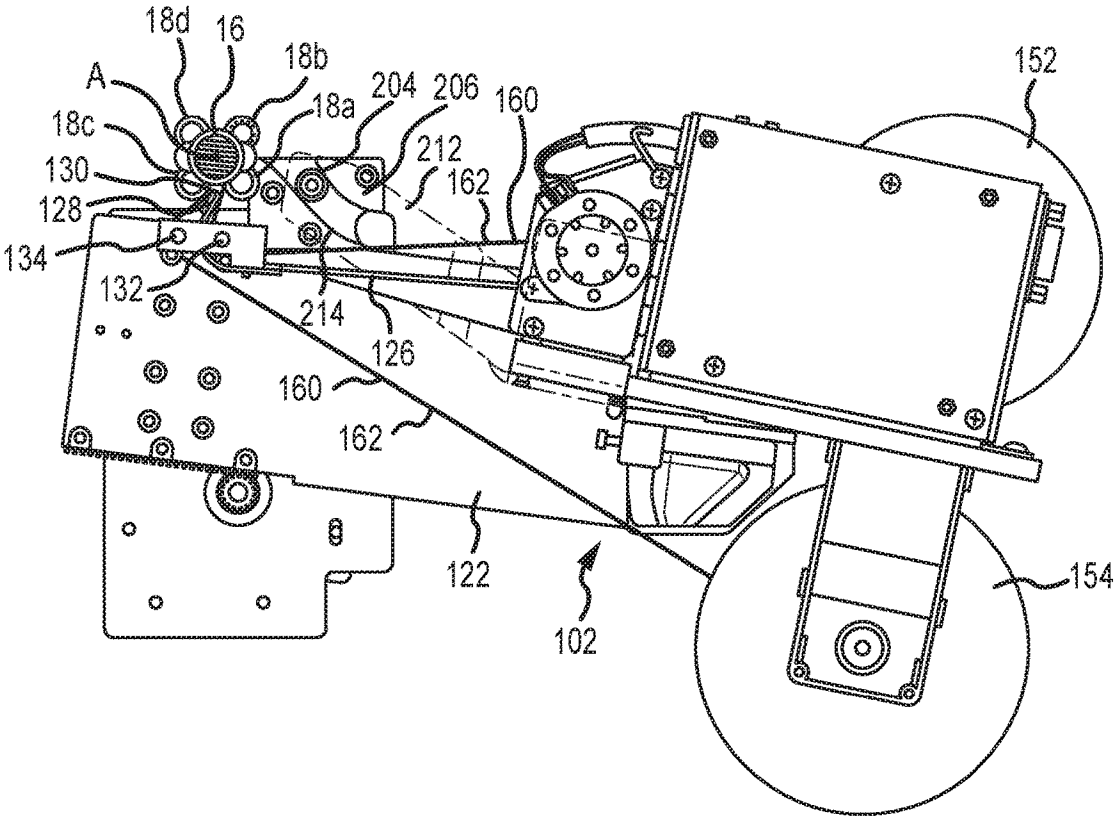
FIG. 4 is a rear view of a label applicator assembly comprising a chassis displaceable by an actuator for movement of the chassis relative to a syringe held by a syringe gripping apparatus, where a follower arm in phantom to illustrate interaction of a cam follower in engagement with a cam.
Figure 5:
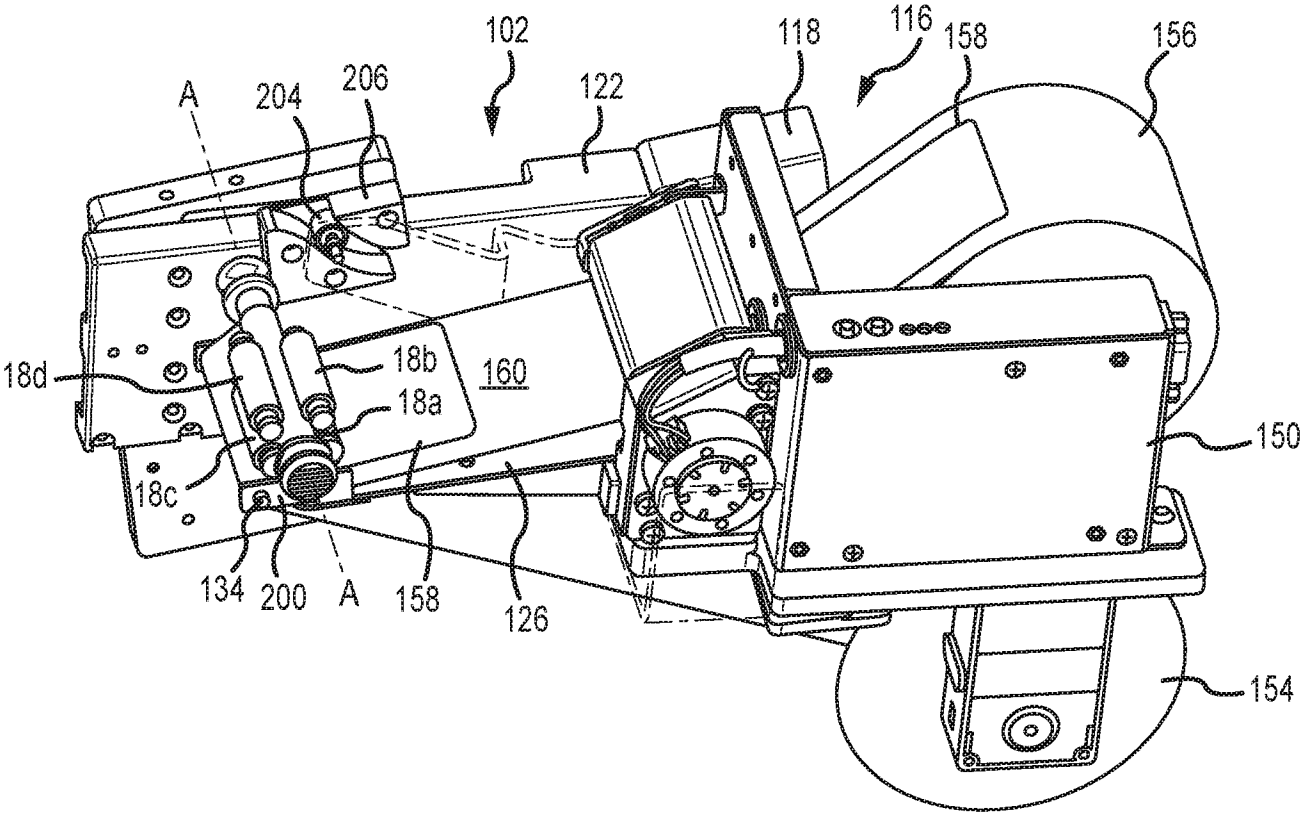
FIG. 5 is a perspective view of a label applicator assembly comprising a chassis displaceable by an actuator for relative movement of the chassis that depicts an embodiment of a follower arm in phantom to illustrate interaction of a cam follower in engagement with a cam.
Figure 9:
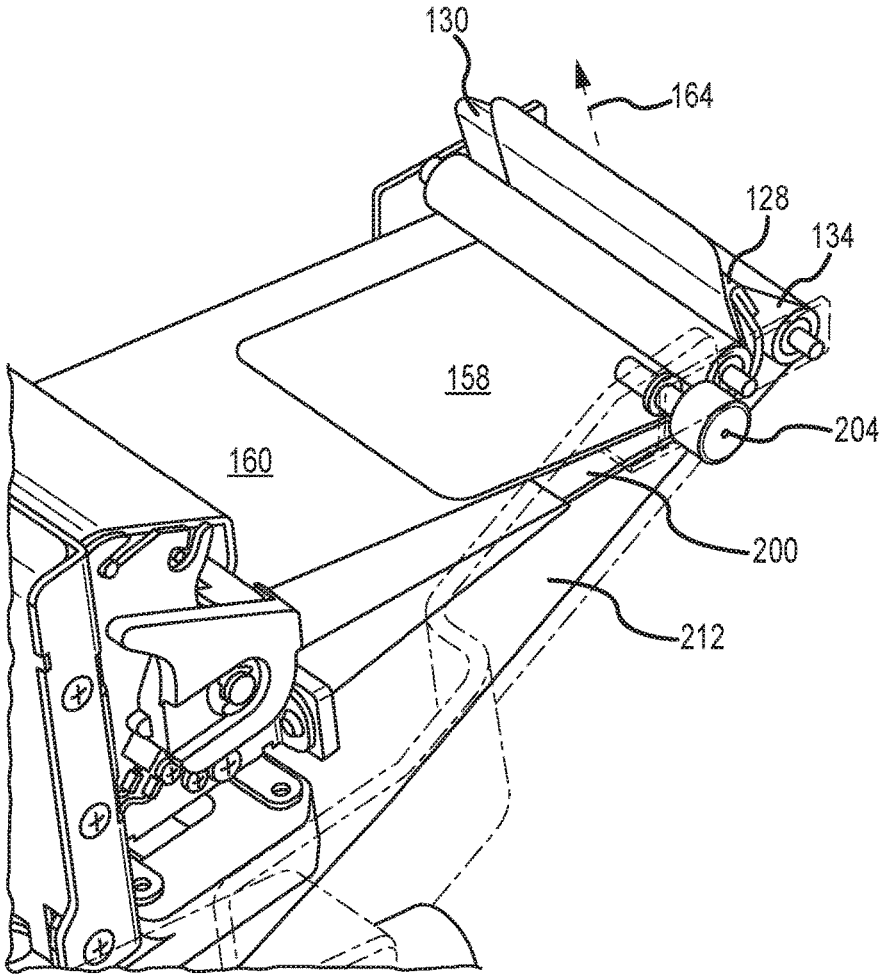
FIG. 9 is a detailed perspective view of a distal end portion of an embodiment of a peeler with a label positioned relative thereto in an advanced position.
Figure 11:
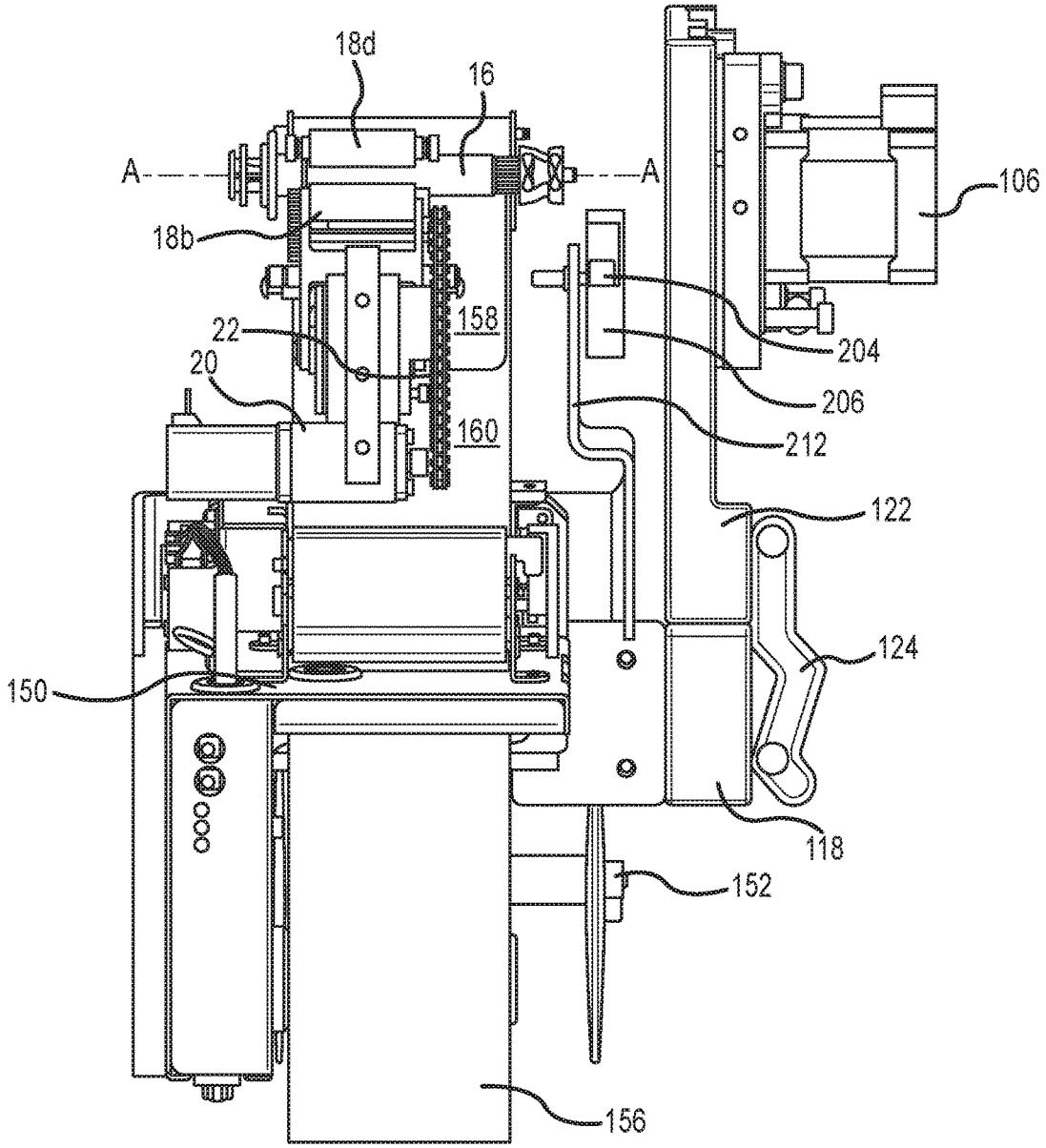
FIG. 11 is a top view of an embodiment of a label applicator disposed relative to a syringe held by a syringe gripping apparatus that shows relative positioning of a label to be applied and a syringe to which the label is to be applied.

For example, with reference to FIGS. 3, 4, and 11, the peeler 200 is shown in position relative to a gripped syringe 16 that is engaged for rotational movement by the gripping members 18*a*, 18*b*, 18*c*, 18*d*. Specifically, the ramp 128 of the peeler 200 may be disposed such that the trajectory 164 (as shown in FIGS. 8 and 9) of the separated label 158 may extend toward the syringe 16. Moreover, in the embodiment depicted in FIGS. 3 and 4, the syringe gripper 12 may be operative to impart, for example, clockwise rotation of the syringe. As can best be seen in FIG. 11, the label 158 may be positioned such that a width 172 of the label 158 may be aligned with a body of the syringe 16. As will be discussed in greater detail below, alignment of the label 158 with the syringe 16 may be facilitated by an offset of the label 158 relative to an edge of the backing material 160.

In any regard, a separated label 158 extending from the ramp 128 may contact the syringe 16 adjacent to the gripping member 18*a*. Specifically, the label 158 may contact the syringe 16 at a position ahead of the gripping member 18*a* with respect to the direction of rotation of the syringe 16. In turn, an adhesive portion of the label 158 may be adhered to the syringe 16 and the label 158 may pass between the roller associated with the gripping member 18*a* and the syringe 16 after contact is made by the label 158 and the syringe 16. Similarly, as the label 158 may be adhered to the syringe 16 undergoing rotation, the label 158 may pass between others of the rollers of the gripping members 18*b*, 18*d*, 18*c* as the syringe 16 continues to rotate. To facilitate application of the label 158 to the syringe 16, the backing material 160 and label 158 may be advanced along the path 162 in corresponding relation to the rotation of the syringe 16. That is, a rate of advancement of the backing material 160 may be matched to the speed of rotation of the syringe 16 such that a length of label 158 separated from the backing material 160 is applied continuously to the body of the syringe 16 undergoing rotation. In turn, any forces (e.g., sheer forces) acting between the label 158 and the body of the syringe 16 may be minimized such that the label 158 may be smoothly applied to the syringe 16. For instance, if the rate at which the backing material 160 and label 158 is advanced is less than the speed of rotation of the syringe 16, the adhesive portion of the label 158 may drag along the body of the syringe 16, which may reduce the adhesive contact between the label 158 and the syringe 16. In contrast, if the rate at which the backing material 160 and label 158 is greater than the speed of rotation of the syringe 16, the label 158 may buckle or wrinkle, which may reduce legibility of information on the label 158 and/or reduce adhesion of the label 158 to the syringe 16.

Because the syringe gripper 12 may engage syringes of different respective diameters, the position of the ramp 128 relative to the syringe gripper 12 may be adjusted such that a separated label 158 may be contacted ahead of a roller of a syringe gripper 18*a*. As described above, the peeler 200 and/or printer 150 may be engaged with the chassis 102 to allow for movement of the peeler 200 with the chassis 102. Specifically, as described above, the chassis 102 may be moved linearly with respect to the mounting plate 104 in a first direction corresponding to this linear movement. Additionally, the chassis 102 may also impart movement of the peeler 200 a second direction that may have at least a component of movement in a generally perpendicular to a first direction of the linear movement of the chassis 102 relative to the mounting plate 104. Specifically, at least the peeler 200 may be moveably attached to the chassis 102 such that the peeler 200 is moveable relative to the chassis 102 in the second direction. The movement of the peeler 200 in the second direction may be prescribed by way of interaction of a cam follower 204 relative to a cam 206 as the chassis 102 is moved in the first direction.

As can be seen in FIGS. 2 and 7, the printer 150 and/or peeler 200 may be mounted to the chassis 102 to allow for movement of the printer 150 and peeler 200 relative to the chassis 102 in the second direction. Specifically, the printer 150 and peeler 202 may be engaged with a hinge 208 to allow for the movement of the printer 150 and peeler 200 in the second direction. In this regard, as the chassis 102 undergoes linear motion in response to actuation of the motor 106, the printer 150 and peeler 200 may undergo corresponding movement about the hinge 208 based on interaction of the cam follower 204 and cam 206 as described below. Specifically, a first side of the hinge 208 may be engaged with the chassis 102. A second side of the hinge 208 may be affixed to a platform that supports the printer 150 and the peeler 200. In turn, the printer 150 and peeler 200 may pivot about the hinge 208. As the peeler 200 pivots, a distal portion thereof (e.g., a distal end of the ramp 128) may move in the second direction perpendicular to the first direction.

The printer 150 and peeler 200 may be biased against movement in the second direction away from the chassis 102 by a biasing member 210 that is engaged with a screw at a first end and a structure of the peeler 200 and printer 150 at an opposite end of the biasing member 210. In this regard, the peeler 200 and printer 150 may be biased against movement in the second direction toward the syringe 16 and away from the chassis 102 corresponding to pivotal movement of the peeler 200 and printer 150 about the hinge 208.

The moveable portion comprising the peeler 200 and printer 150 may include a cam arm 212 that supportably engages the cam follower 204. This cam arm 212 is shown in phantom in FIGS. 4 and 5 to illustrate the engagement of the cam follower 204 with the cam 206. The cam arm 212 may position the cam follower 204 for engagement with the cam 206 upon linear movement of the chassis 102 relative to the mounting plate 104. In this regard, it may be appreciated that the cam 206 may be mounted to a structure such that the cam 206 remains stationary relative to the syringe gripper 12. For instance, the cam 206 may also be engaged with a frame structure 14 of the syringe filler 10.

In any regard, the cam follower 204 may engage a profiled surface 214 of the cam 204. The profiled surface 214 may define a profile 216 of the cam 204 (which is depicted by an arrow in FIG. 10). Specifically, the profile 216 of the cam 204 defined by the profiled surface 214 may correspond with various different syringe diameters that are capable of being handled by the syringe gripper 12. That is, the linear motion of the chassis 102 produced by actuation of the motor 106 may move the peeler 200 in a direction corresponding to the linear motion of the chassis 102. At the same time, the linear motion of the chassis 102 may result in the cam follower 204 engaging the cam 206 such that the cam follower 204 follows the cam profile 216 to move the printer 150 and peeler 200 about the hinge 208 such that the ramp 128 also undergoes movement in the second direction in a manner defined by the cam profile 216. In turn, the degree of advancement of the chassis 102 in the first direction by the motor 106 may both control the position of the ramp 128 along the first direction and in the second direction. Accordingly, preprogrammed positions of the chassis 102 in the first direction may determine respective placements of the ramp 128 relative to syringes of different sizes that may be gripped by the syringe gripper 12.

In turn, upon determination of a diameter of a syringe 16, a predetermined position of the chassis 102 in the first dimension may be determined that corresponds with the diameter of the syringe 16. In turn, the chassis 102 may be moved to a predetermined position, which results in movement of the ramp 128 to a position relative to the syringe 16 in both the first direction and the second direction for a corresponding given diameter of syringe 16 such that a label 158 advanced along the trajectory 164 relative to the inflection point 130 of the ramp 128 may contact the syringe 16 of the given diameter ahead of a roller of a gripping member 18*a* for application of the label 158 to the syringe 16 as described above. Moreover, upon engagement of a syringe 16 of another different size, the chassis 102 may be moved into another different position in the first dimension, thus positioning the ramp 128 in a position for label application to the syringe 16 of the different size. In turn, for each given diameter of a syringe 16 to which a label 158 is to be applied, a corresponding position of the chassis 102 may be provided to position the ramp 128 relative to each given diameter for label application by the positioning of the chassis 102 in the first direction corresponding to the linear motion of the chassis 102 and in the second direction based on the engagement of the cam follower 204 with the cam 206.

Figure 12:
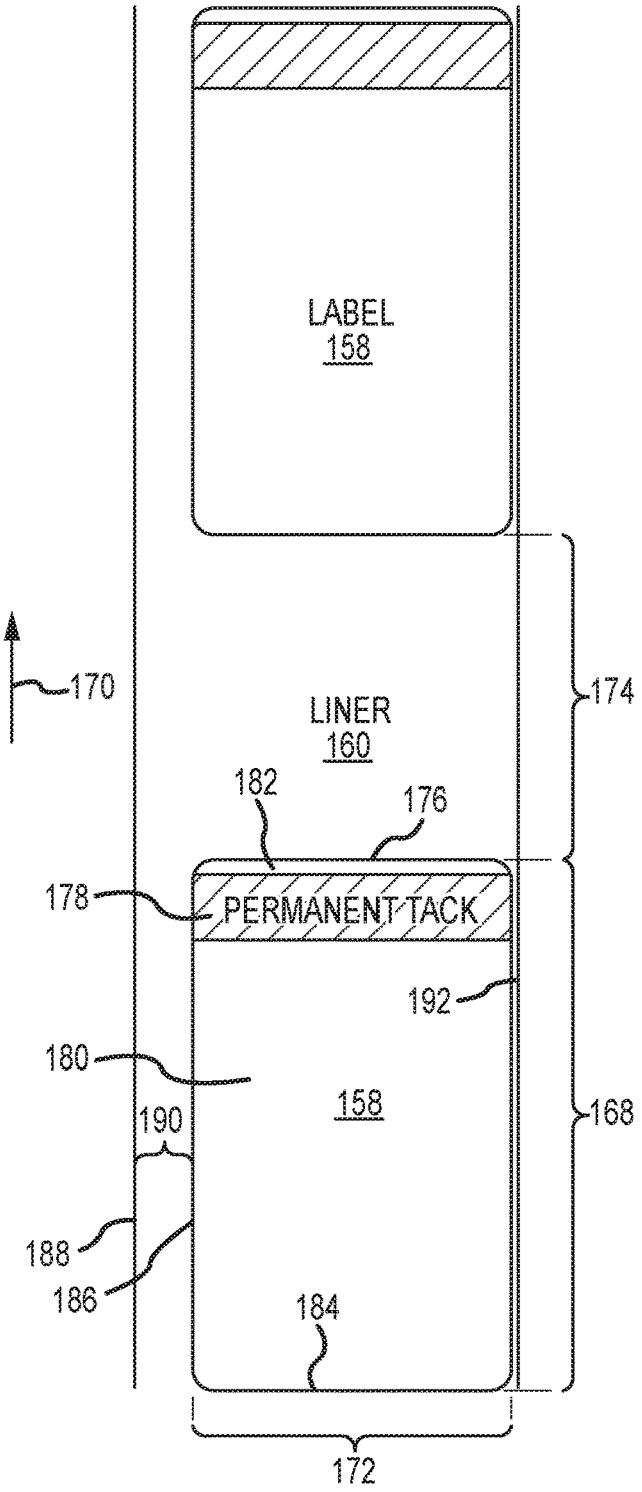
FIG. 12 illustrates an embodiment of a portion of a label roll comprising labels disposed on a backing material for use with a label applicator.

With further reference to FIG. 12, an embodiment of a label 158 disposed on backing material 160 that may be used with a label applicator 100 described herein is depicted. As may be appreciated, the label 158 may be disposed on the backing material 160. Specifically, the label 158 may have a first side and a second side. The first side of the label 158 may be in contacting engagement with the backing material 160 and may come in a supply roll 156. The second side may be opposite the first side and may face away from the backing material 160. The second side may be configured such that the printer 150 may print information on the second side. The label 158 may have a length 168 that generally extends along a direction of advancement 170 of the backing material 158. The label 158 may also have a width 172 perpendicular to the direction of advancement 170. Moreover, adjacent labels 158 may be spaced on the backing material 160 by a label separation distance 174.

As briefly described above, an edge 186 of the label 158 may be offset from an edge 188 of the backing material 160 by an offset distance 190. Specifically, the offset distance 190 on a first side of the label 158 may be greater than an opposite offset distance 192 on an opposite side of the label 158. As described above, the offset positioning of the label 158 with respect to the direction corresponding to the label width 172 may be for positioning of the label 158 relative to the syringe 16.

Each label 158 may have an adhesive portion 178 on the first side thereof. The adhesive portion 178 may have a pressure sensitive adhesive or the like that may adhere to a syringe 16 when contacted therewith. As may be appreciated, the adhesive portion 178 may be spaced from a leading edge 176 of the label 158 by an offset. In this regard, a leading non-adhesive portion 182 may be provided adjacent to the leading edge 176 of the label. This leading non-adhesive portion 182 may assist in separation of the label 158 from the backing material 160 as the backing material 160 passes through the inflection point 130 defined by the ramp 128 of the peeler 200. Moreover, the adhesive portion 182 may extend a distance along the length 168 of the label 158 less than the entirety of the length 168. That is, there may be a second non-adhesive portion 180 that trails the adhesive portion 178 relative to the direction of advancement 170. This second non-adhesive portion 180 may extend to a trailing edge 184 of the label 158. In this regard, the second non-adhesive portion 180 may create a flag that may extend from the syringe 16 when the adhesive portion 178 of the label 158 is adhered to the syringe 16.

Moreover, while the leading non-adhesive portion 182 and the second non-adhesive portion 180 are described as non-adhesive, either or both of these portions may be less adhesive than the adhesive portion 178. That is, these portions may be tacky such that the non-adhesive portions cling or otherwise non-permanently adhere to the syringe 16 and/or a portion of the second side of the label 158. As such, upon application of the label 158 to the syringe 16, the entire label 158 may pass between at least one of the rollers of the gripper mechanisms 18*a*, 18*b*, 18*c*, 18*d*. In turn, the adhesive portion 178 may be adhered to the syringe 16 and the second non-adhesive portion 180 may contact in clinging engagement to the syringe 16 and/or the second side of the label 158. In turn, the second non-adhesive portion 180 may subsequently be peeled away from the second side of the label 158 and/or syringe 160 to create a flag extending from the syringe 16. For example, the flag may be peeled away from the syringe 16 to view additional information printed on the second side of the label 158. As the second non-adhesive portion 180 may have a degree of tack, the flag corresponding to the second non-adhesive portion 180 may be returned to clinging engagement after being peeled away.

As described above, adjacent labels 158 on the backing material 160 may be spaced by a label separation distance 174. As may be appreciated, as a first label 158 is printed and advanced to the ramp 128 for separation from the backing material 160 and application to the syringe 16, a second label 158 on the backing material 158 may also be advanced along the path 162. Accordingly, if the label separation distance 174 is not sufficiently large, a second or subsequent label 158 may pass through the printer 150 prior to or concurrently with application of a first or previous label 158. In the event that the contents or relevant information for a subsequent syringe 16 is known, this may not be an issue as the subsequent label 158 may simply be printed with the relevant information as it passes through the printer 150. However, if information regarding the subsequent syringe 16 is not known at the time of the label of a given syringe 16, having the subsequent label 158 pass through the printer 150 may be disadvantageous as it may not be possible to retract the label relative to the printer 150 once the subsequent label 158 is advanced beyond the printer 150.

As such, in an embodiment of the supply roll 156 of labels 158, the label separation distance 174 may be sufficiently large such that a subsequent label 158 does not exit the printer 150 upon complete separation of a previous label 158 when applied a syringe 16. However, as an example, a subsequent label 158 may partially exit the printer 150. However, a trailing edge 184 of the subsequent label 158 may not pass a threshold of the printer 150 such that the backing material 160 may be retracted to position the subsequent label 158 relative to the printer for printing information on the subsequent label 158 after a prior label 158 has been applied to a syringe 16. In this regard, a label applicator 100 using a supply roll 156 of labels with such a label separation distance 174 may facilitate ad hoc printing such that a subsequent syringe 16 may be labeled even if information regarding the subsequent syringe 16 is not known at the time of labeling a prior syringe 16 with a prior label 158.

Figure 13:
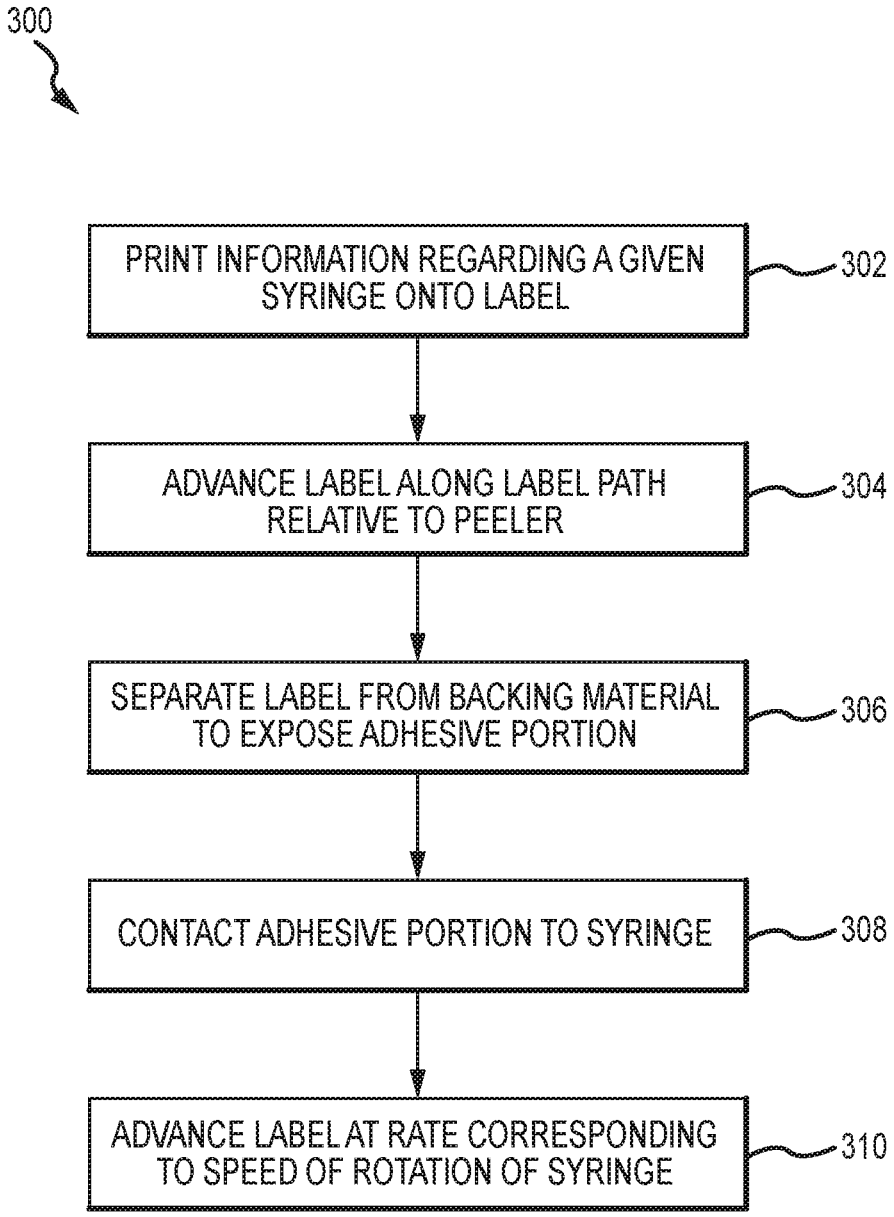
FIG. 13 illustrates an embodiment of a method for application of a label to a syringe.

Turning to FIG. 13, a flowchart that depicts an embodiment of a method 300 that may be used to apply a label 158 to a syringe 16 is shown. The method 300 may include printing 302 information regarding a given syringe 16 to which the label 158 is to be applied onto the label 158. This may include advancing the label 158 through a printer 150 for printing 302 of the information onto the label 158. Additionally or alternatively, the printer 150 may be moved to print 302 the information onto the label 158. The method 300 may also include advancing 304 the label 158 along a path 162. The advancing 304 may result in the label 158, which may be disposed on backing material 160, being advanced toward a distal end of the peeler 200 to a ramp 128. In turn, the method 300 may include separating 306 the label 158 from the backing material 160. The separating 306 may result from advancing 304 of the label 158 beyond an inflection point 130 of the ramp 128 such that the backing material 160 is peeled away from the label 158 and the label 158 continues along a trajectory 164 as described above. That is, the amount of label 158 separated 306 from the backing material 160 may depend on the advancing 304 of the label 158 along the label path 162.

In any regard, once the label 158 is at least partially separated 306 from the backing material 160 to expose an adhesive portion 178 of the label 158, the method 300 may include contacting 308 the adhesive portion 178 to the syringe 16. In this regard, the adhesive portion 178 may be contacted 308 with the syringe 16 upon further advancement 304 of the backing material 160 that at least partially supports the label 158 along the path 162. That is, advancement 304 of the label backing 160 along the path 162 may result in the label 158 being separated 306 from the backing material 160 for positioning the separated portion of the label 158 containing the adhesive portion 178 with the syringe 16. Further still, the method 300 may include advancing 310 the label at a rate corresponding to the speed of rotation of the syringe 16. Accordingly, and as described above, the advancing 310 may result in smooth application of the label 158 to the syringe 16 without relative sliding, buckling, or any other shear forces between the label 158 and the syringe 16. Further still, it may be appreciated that the speed of rotation of the syringe 16 (e.g., by influence of the syringe gripper 12 as described above) may be dependent upon the diameter of the syringe 16. In turn, the rate at which the label 158 is advanced 310 may also be, at least in part, dependent upon the diameter of the syringe 16 to which the label 158 is to be applied.

As may be appreciated, the steps of the method 300 shown in FIG. 13 and described above may be at least partially performed concurrently or in a different order than as presented in the flowchart of FIG. 13. As such, while FIG. 13 presents these steps successively, it may be appreciated that steps need not occur in the specific order presented or sequentially.

Figure 14:
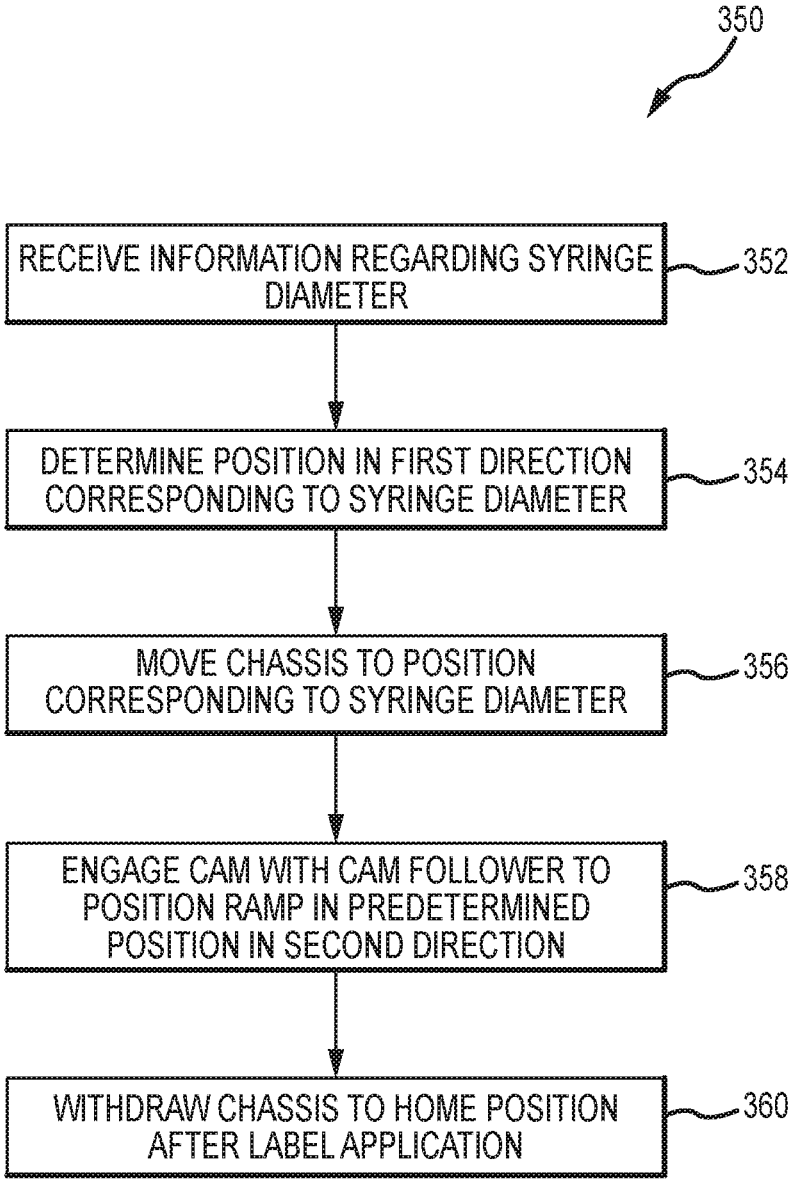
FIG. 14 illustrates an embodiment of a method for movement of a label applicator into position relative to a syringe for application of a label to the syringe.

Moreover, the method 300 of FIG. 13 may be performed in conjunction with a method used to position a label applicator 100 in position relative to a syringe 16 to be labeled. An embodiment of such a method 350 for positioning a label applicator 100 relative to a syringe 16 to be labeled is presented with reference to FIG. 14. Specifically, the method 350 may include receiving 352 information regarding a diameter of a syringe 16 to which a label 158 is to be applied. For instance, when used in combination with an automated syringe filler 10, the automated syringe filler 10 may have sensors that are operative to determine a diameter of a syringe 16 to be labeled. In turn, information regarding the diameter of the syringe 16 may be provided to a controller operative to control the motor 106 for movement of the chassis 102.

In any regard, once the information regarding the diameter of a syringe 16 is received, a position in the first direction may be determined 354 that corresponds to the syringe diameter 354. In turn, the chassis 102 may be moved 356 into the position that is determined 354 from the syringe diameter. Furthermore, the method 350 may include engaging 358 a cam 206 with a cam follower 204 to position the ramp 128 of the peeler 200 in a predetermined position in the second direction. Specifically, the engagement 358 may be in response to moving 356 the chassis 102 into the corresponding position in the first direction. In any regard, the moving 356 and/or engaging 358 may be utilized to position the ramp 128 relative to the syringe to be labeled. In turn, the chassis 102 may be withdrawn 360 to a home position after a label has been applied to the syringe 16.

While the invention has been illustrated and described in detail in the drawings and foregoing description, such illustration and description is to be considered as exemplary and not restrictive in character. For example, certain embodiments described hereinabove may be combinable with other described embodiments and/or arranged in other ways (e.g., process elements may be performed in other sequences). Accordingly, it should be understood that only the preferred embodiment and variants thereof have been shown and described and that all changes and modifications that come within the spirit of the invention are desired to be protected.

What is claimed is:

1. A label applicator for application of a label to a syringe, comprising:

a syringe gripper that maintains a syringe in a position along a predetermined axis, wherein the syringe gripper rotates the syringe about the predetermined axis;

a printer that prints information onto a label disposed on a backing material; and a peeler defining a path along which the label and the backing material is advanced, wherein the peeler separates the label from the backing material to dispose an adhesive portion of the label in engagement with the syringe;

wherein a rate of advancement of the label is based on a speed of rotation of the syringe by the syringe gripper, wherein the printer and the peeler are mounted on a chassis that is moveable relative to the predetermined axis, wherein the chassis is linearly moveable in a first direction relative to the predetermined axis, and wherein at least the peeler comprises a displaceable portion for movement relative to the chassis in a second direction different than the first direction, wherein the displaceable portion comprises a cam follower that engages a cam that defines a prescribed movement of at least the peeler in the second direction for positioning of the adhesive portion of the label in engagement with the syringe upon separation of the label from the backing material, wherein the syringe gripping apparatus engages different respective syringes of a plurality of diameters, and wherein the cam defines a plurality of positions relative to the linear motion of the chassis corresponding to the plurality of diameters.

2. The label applicator of claim 1, wherein the prescribed movement comprises advancement of the peeler toward the predetermined axis in the second direction in response to movement of the chassis in the first direction, at least a component of the second direction being perpendicular to the linear motion of the chassis in the first direction.

3. The label applicator of claim 2, wherein the displaceable portion is pivotal relative to the chassis.

4. The label applicator of claim 1, wherein the syringe gripping apparatus comprises at least one roller, and wherein the peeler disposes the label in contacting engagement with the syringe relative to the roller such that the label passes between the at least one roller and the syringe after engagement of the adhesive portion of the label with the syringe and upon rotation of the syringe by the syringe gripping apparatus.

5. The label applicator of claim 1, wherein the label comprises a width perpendicular to a direction of advancement of the label along the path, a length along the direction of advancement of the label along the path, a first side in contacting engagement with the backing material and a second side opposite the first side on which the printer prints the information, and wherein the adhesive portion extends on the first side along a first portion of the length of the label less than the length.

6. The label applicator of claim 5, wherein the adhesive portion of the label is offset from a leading edge of the label relative to the direction of advancement.

7. The label applicator of claim 6, wherein the adhesive portion of the label is offset from the leading edge of the label relative to the direction of advancement a distance less than the first portion of the length along which the adhesive portion extends.

8. The label applicator of claim 6, wherein the label comprises a tacky portion on the first side in an area mutually exclusive of the adhesive portion, wherein the tacky portion is repeatedly detachably engageable with the second side of the label.

9. The label applicator of claim 1, wherein the backing material comprises a plurality of labels for application to a corresponding plurality of syringes, wherein adjacent labels on the backing are spaced such that a subsequent label is printed after application of a given label to a syringe.

10. The label applicator of claim 9, wherein the subsequent label is moved into position relative to the printer for printing on the subsequent label by reversing the backing material relative to the path prior to printing.

11. The label applicator of claim 1, further comprising a supply roll comprising a plurality of labels disposed on the backing material; and a take-up roll about which backing material is wound subsequent to separation from the label, wherein the path is defined between the supply roll and the take-up roll; and wherein the path comprises an inflection point at which the label is separated from the backing material, and wherein at least one roller is disposed for contacting engagement with the backing material to reduce friction between the backing material and the peeler adjacent to the inflection point.

* * * * *